US010851639B2

(12) United States Patent
Bailey et al.

(10) Patent No.: US 10,851,639 B2
(45) Date of Patent: Dec. 1, 2020

(54) METHOD FOR DRILLING WELLBORES UTILIZING A DRILL STRING ASSEMBLY OPTIMIZED FOR STICK-SLIP VIBRATION CONDITIONS

(71) Applicants: Jeffrey R. Bailey, Houston, TX (US); Gregory S. Payette, Spring, TX (US)

(72) Inventors: Jeffrey R. Bailey, Houston, TX (US); Gregory S. Payette, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 324 days.

(21) Appl. No.: 15/938,821

(22) Filed: Mar. 28, 2018

(65) Prior Publication Data

US 2018/0283161 A1 Oct. 4, 2018

Related U.S. Application Data

(60) Provisional application No. 62/479,909, filed on Mar. 31, 2017.

(51) Int. Cl.
*E21B 44/04* (2006.01)
*E21B 45/00* (2006.01)
*E21B 44/00* (2006.01)

(52) U.S. Cl.
CPC ..... *E21B 44/04* (2013.01); *E21B 44/00* (2013.01); *E21B 45/00* (2013.01)

(58) Field of Classification Search
None
See application file for complete search history.

(56) References Cited

U.S. PATENT DOCUMENTS

| | | | | |
|---|---|---|---|---|
| 5,852,235 | A | 12/1998 | Pavone et al. | |
| 6,363,780 | B1 | 4/2002 | Rey-Fabret et al. | |
| 7,896,105 | B2 | 3/2011 | Dupriest | |
| 8,589,136 | B2 | 11/2013 | Ertas et al. | |
| 8,798,978 | B2 | 8/2014 | Ertas et al. | |
| 8,977,523 | B2 * | 3/2015 | Ertas | E21B 44/00 703/2 |
| 9,483,586 | B2 | 11/2016 | Bailey et al. | |

(Continued)

FOREIGN PATENT DOCUMENTS

WO WO 2010/064031 6/2010

OTHER PUBLICATIONS

Chang, D., et al. (2014) "Field Trial Results of a Drilling Advisory System", *IPTC 17216*. International Petroleum Technology Conference, Jan. 19-22, Doha, Qatar, pp. 1-13.

(Continued)

*Primary Examiner* — Manuel A Rivera Vargas
(74) *Attorney, Agent, or Firm* — ExxonMobil Upstream Research Company — Law Department

(57) ABSTRACT

The present disclosure relates generally to the field of drilling operations. More particularly, the present disclosure relates to methods for drilling wells utilizing drilling equipment, more particularly drill string assemblies, and predicting modified drilling operation conditions based on proposed changes to the drill string configuration and/or the drilling parameters. Included are methods for drilling wells utilizing a method for the selection of modified drill string assemblies and/or modified drilling parameters.

25 Claims, 19 Drawing Sheets

(56) References Cited

U.S. PATENT DOCUMENTS

2009/0055135 A1 2/2009 Tang et al.

OTHER PUBLICATIONS

Clayer, F. et al. (1990) "The Effect of Surface and Downhole Boundary Conditions on the Vibration of Drillstrings", SPE 20447-MS, SPE Annual Technical Conference and Exhibition, Sep. 23-26, New Orleans, Louisiana, pp. 431-442.

Ertas, D., et al. (2014), "Drillstring Mechanics Model for Surveillance, Root Cause Analysis, and Mitigation of Torsional and Axial Vibrations", *SPE-163420-PA*, , 2013 SPE/IADC Drilling Conference and Exhibition in Amsterdam, The Netherlands, Mar. 5-7, 2013, pp. 405-417.

Halsey, G.W., et al. (1988) "Torque Feedback Used to Cure Slip-Stick Motion", *SPE-18049-MS*, SPE Annual Technical Conference and Exhibition, Oct. 2-5, Houston, Texas, pp. 277-282.

Payette et al. (2015) "Mitigating Drilling Dysfunction Using a Drilling Advisory System: Results from Recent Field Applications", IPTC 18333-Ms, International Petroleum Technology Conference, Dec. 6-9, Doha, Qatar pp. 1-23.

Vandiver, J.K., et al. (1986) "Coupled Axial, Bendihng, and Torsional Vibration of Rotating Drill Strings", DEA Project 29, Phase III Report, Massachusettes Institute of Technology; pp. 1-38.

Payette et al. (2015) "Mitigating Drilling Dysfunction Using a Drilling Advisory System: Results from Recent Field Applications", IPTC-18333-MS, International Petroleum Technology Conference, Doha, Qatar, Dec. 6-9, 2015, pp. 1-23; XP055487824, ISBN: 978-1-61399-378-1.

* cited by examiner

Well 2 Data

Specific Surface Torque Swing per RPM (kft-lbs/RPM)

METHOD FOR DRILLING WELLBORES UTILIZING A DRILL STRING ASSEMBLY OPTIMIZED FOR STICK-SLIP VIBRATION CONDITIONS

CROSS REFERENCE TO RELATED APPLICATION

This application claims the benefit of U.S. Provisional Application Ser. No. 62/479,909 filed Mar. 31, 2017 entitled METHOD FOR DRILLING WELLBORES UTILIZING A DRILL STRING ASSEMBLY OPTIMIZED FOR STICK-SLIP VIBRATION CONDITIONS, the disclosure of which is incorporated herein by reference in its entirety.

FIELD

The present disclosure relates generally to the field of drilling operations. More particularly, the present disclosure relates to methods for drilling wells utilizing drilling equipment, more particularly drill string assemblies, that are modified in design based on measured and predicted stick-slip vibration conditions based on drilling operations data obtained from a well being drilled or a separate well.

BACKGROUND

This section introduces various aspects of art that may be associated with some embodiments of the present invention to facilitate a better framework for understanding some of the various techniques and applications of the claimed subject matter. Accordingly, it should be understood that these Background section statements are to be read in this light and not necessarily as admissions of prior art.

Vibrations incurred in drill string assemblies during the drilling process are known to potentially have a significant effect on Rate of Penetration (ROP) and represent a significant challenge to interpret and mitigate in pursuit of reducing the time and cost of drilling subterranean wells. Drill string assemblies (or "drill strings") vibrate during drilling for various reasons related to one or more drilling parameters. For example, the rotary speed (RPM), weight on bit (WOB), bit design, mud viscosity, etc. each may affect the vibrational tendency of a given drill tool assembly during a drilling operation. Measured depth (MD), rock properties, hole conditions, and configuration of the drill tool assembly may also influence drilling vibrations. As used herein, drilling parameters include characteristics and/or features of both the drilling hardware (e.g., drill string assembly) and the drilling operations.

As used herein, drill string assembly (or "drill string" or "drill assembly") refers to assemblies of components used in drilling operations. Exemplary components that may collectively or individually be considered a part of the drill string include rock cutting devices, bits, mills, reamers, bottom hole assemblies, drill collars, drill strings, couplings, subs, stabilizers, MWD tools, etc. Exemplary rig systems may include the top drive, rig control systems, etc., and may form certain boundary conditions. Deployment of vibrationally poor drill tool assembly designs and conducting drilling operations at conditions of high downhole vibrations can result in loss of rate of penetration, shortened drill tool assembly life, increased number of trips, increased failure rate of downhole tools, and increased non-productive time.

A fixed cutter bit often requires more torque than a corresponding roller cone bit drilling similar formations at comparable conditions, although both bits can experience torsional vibration issues. The "bit friction factor" describes how much torque is required for a bit to drill as a function of bit weight, wherein more aggressive bits have higher friction factors. Increased bit torque and fluctuations in bit torque can lead to an increase in the phenomenon known as "stick-slip," an unsteady rotary speed at the bit, even when surface RPM remains substantially constant. Excessive stick-slip can be severely damaging to drill string assemblies and associated equipment. Bits with higher friction factors typically encounter more torsional stick-slip vibrations than bits with lower friction factors, but they can also drill at faster rates. Roller cone bits may sometimes be more prone to axial vibration issues than corresponding fixed cutter bits. Although axial vibrations may be reduced by substituting fixed cutter bits for roller cone bits, some drilling operations with either type of bit may continue to experience axial vibration problems. Fixed cutter bits can be severely damaged by axial vibrations as the PDC (Polycrystalline Diamond Compact) wafer of the bit can be knocked off its substrate if the axial vibrations are too severe. Axial vibrations are known to be problematic for rotary tricone bits, as the classic trilobed bottomhole pattern generates axial motion at the bit. There are known complex mathematical and operational methods for measuring and analyzing downhole vibrations. However, these typically require a substantial amount of data, strong computational power, and special skill to use and interpret.

Typically, severe axial vibration dysfunction can be manifested as "bit bounce," which can result in a momentary lessening or even a momentary complete loss of contact between the rock formation and the drill bit cutting surface through part of the vibration cycle. Such axial vibrations can cause dislocation of PDC cutters and tricone bits may be damaged by high shock impact with the formation. Dysfunctional axial vibration can occur at other locations in the drill string assembly. Other cutting elements in the drill string assembly could also experience a similar effect. Small oscillations in weight on bit (WOB) can result in drilling inefficiencies, leading to decreased ROP. For example, the depth of cut (DOC) of the bit typically varies with varying WOB, giving rise to fluctuations in the bit torque, thereby inducing torsional vibrations. The resulting coupled torsional-axial vibrations may be among the most damaging vibration patterns as this extreme motion may then lead to the generation of lateral vibrations.

Some patent applications and technical articles have addressed mathematical methods and processes for real-time measurements of stick-slip conditions in an operating drilling system and propose methods to alert the drilling operator when stick-slip conditions are likely to occur. Other data analysis/control systems are knowledge-based systems which by analyzing drilling data can "learn" under which conditions stick-slip is likely to occur. These systems provide many alerts to the drilling operator when such conditions are likely to occur or are occurring, suggesting to the operator drilling parameters to minimize stick-slip conditions, or control operations to minimize stick-slip conditions while maximizing operational parameters such as Rate of Penetration (ROP).

Recently developed practices around optimizing the Bottom-Hole Assembly (BHA) design (U.S. Pat. No. 9,483,586) and drilling parameters for robust vibrational performance, and using real-time Mechanical Specific Energy (MSE) monitoring for surveillance of drilling efficiency (U.S. Pat. No. 7,896,105) have significantly improved drilling performance. MSE is particularly useful in identifying drilling inefficiencies arising from, for example, dull bits, poor weight transfer to the bit, and whirl. These dysfunctions tend to reduce ROP and increase expended mechanical power due to the parasitic torques generated, thereby increasing MSE. The availability of real-time MSE monitoring for surveillance allows the driller to take corrective action. One of the big advantages of MSE analysis is that it does not require real-time downhole tools that directly measure vibration severity, which are expensive and prone to malfunction in challenging drilling environments.

Multiple efforts have been made to study and/or model these more complex torsional and axial vibrations, some of which are discussed here to help illustrate the advances made by the technologies of the present disclosure. DEA Project 29 was a multi-partner joint industry program initiated to develop modeling tools for analyzing drill tool assembly vibrations. The program focused on the development of an impedance-based, frequency-dependent, mass-spring-dashpot model using a transfer function methodology for modeling axial and torsional vibrations. These transfer functions describe the ratio of the surface state to the input condition at the bit. The boundary conditions for axial vibrations consisted of a spring, a damper at the top of the drill tool assembly (to represent the rig) and a "simple" axial excitation at the bit (either a force or displacement). For torsional vibrations, the bit was modeled as a free end (no stiffness between the bit and the rock) with damping. This work also indicated that downhole phenomena such as bit bounce and stick-slip are observable from the surface. While the DEA Project 29 recognized that the downhole phenomena were observable from the surface, they did not specifically attempt to quantify this. Results of this effort were published as "Coupled Axial, Bending and Torsional Vibration of Rotating Drill Strings", DEA Project 29, Phase III Report, J. K. Vandiver, Massachusetts Institute of Technology and "The Effect of Surface and Downhole Boundary Conditions on the Vibration of Drill strings," F. Clayer et al, SPE 20447, 1990.

Additionally, U.S. Pat. No. 5,852,235 ('235 patent) and U.S. Pat. No. 6,363,780 (780 patent) describe methods and systems for computing the behavior of a drill bit fastened to the end of a drill string. In '235, a method was proposed for estimating the instantaneous rotational speed of the bit at the well bottom in real-time, taking into account the measurements performed at the top of the drill string and a reduced model. In '780, a method was proposed for computing "Rf, a function of a principal oscillation frequency of a weight on hook WOH divided by an average instantaneous rotating speed at the surface of the drill string, Rwob being a function of a standard deviation of a signal representing a weight on bit WOB estimated by the reduced physical model of the drill string from the measurement of the signal representing the weight on hook WOH, divided by an average weight on bit $WOB_0$ defined from a weight of the drill string and an average of the weight on hook $WOH_0$, and any dangerous longitudinal behavior of the drill bit determined from the values of Rf and Rwob" in real-time.

These methods require the capability to run in real-time and a "reduced" model that can accept a subset of measurements as input and generate outputs that closely match the remaining measurements. For example, in '235 the reduced model may accept the surface RPM signal as an input and compute the downhole RPM and surface torque as outputs. However, the estimates for quantities of interest, such as downhole RPM, cannot be trusted except for those occurrences that obtain a close match between the computed and measured surface torque. This typically requires continuously tuning model parameters, since the torque measured at the surface may change not only due to torsional vibrations but also due to changes in rock formations, bit characteristics, borehole patterns, etc., which are not captured by the reduced model. Since the reduced model attempts to match the dynamics associated with relevant vibrational modes as well as the overall trend of the measured signal due to such additional effects, the tuned parameters of the model may drift away from values actually representing the vibrational state of the drilling assembly. This drift can result in inaccurate estimates of desired parameters.

Another disadvantage of such methods is the requirement for specialized software, trained personnel, and computational capabilities available at each drilling operation to usefully utilize and understand such systems.

Patent application publication entitled "Method and Apparatus for Estimating the Instantaneous Rotational Speed of a Bottom Hole Assembly," (WO 2010/064031) continues prior work in this area as an extension of IADC/SPE Publication 18049, "Torque Feedback Used to Cure Slip-Stick Motion," and previous related work. One primary motivation for these efforts is to provide a control signal to the drilling apparatus to adjust the power to the rotary drive system to reduce torsional drill string vibrations. A simple drill string compliance to function is disclosed providing a stiffness element between the rotary drive system at the surface and the bottom hole assembly. Inertia, friction, damping, and several wellbore parameters are excluded from the drill string model. Also, the '031 reference fails to propose means to evaluate the quality of the torsional vibration estimate by comparison with downhole data, offers only simple means to calculate the downhole torsional vibrations using a basic torsional spring model, provides few means to evaluate the surface measurements, does not discuss monitoring surface measurements for bit axial vibration detection, and does not use the monitoring results to make a comprehensive assessment of the amount or severity of stick-slip observed for a selected drilling interval. This reference merely teaches a basic estimate of the downhole instantaneous rotational speed of the bit for the purpose of providing an input to a surface drive control system. Such methods fail to enable real-time diagnostic evaluation and indication of downhole dysfunction.

Other patents are related to improved methods to estimate the effective vibration amplitudes of the bottom of the drill tool assembly, such as at or near a drill bit, based on evaluation of selected surface operating parameters and use the information to enhance drilling operations (U.S. Pat. No. 8,977,523). In this method, data can be taken from the well drilling operations to determine a Torsional Severity Estimate ("TSE") which is then utilized to assist the system to determine drilling operational parameters to minimize stick-slip (especially severe stick-slip) vibrations while drilling a well. A paper entitled "Drillstring Mechanics Model for Surveillance, Root Cause Analysis, and Mitigation of Torsional and Axial Vibrations" was presented at the 2013 SPE/IADC Drilling Conference and Exhibition in Amsterdam, The Netherlands, 5-7 Mar. 2013 (SPE/IADC Presentation No. 163420). It describes similar methods as in the U.S. Pat. No. 8,977,523 patent for a surveillance system utilizing real time well operating data, calculating a current value of the TSE, and generating an envelope for Max/Min RPM of the drill string assembly which is displayed to a drilling operator for drilling monitoring purposes. This reference identifies a linear relationship between stick-slip resistance and rotary speed (RPM). It is further known that, to first order, bit torque is linear in friction factor $\mu$ and also in Weight-on-Bit (WOB). The operator may make changes in the actual drilling operation, such as adjusting the RPMs, the WOB, the ROP or other parameters to maintain the drilling operation within a window to minimize stick-slip conditions and actual stick-slip vibrations.

All of these systems for monitoring and operating a well drilling operation are helpful in drilling operations, but only after the drill string assembly has been designed and installed. None of these systems provides the drilling engineer with a method for drill string design that would be helpful in optimizing or reducing the stick-slip conditions of a proposed drilling operation. In the prior art, once the drill string assembly has been installed, drilling operations have to be adjusted in the drilling operation to within tolerable conditions for the selected drill string assembly. That is, in the prior art, the drilling operation may not be operated under the most efficient conditions, because the non-optimized selection of a drill string assembly becomes a limiting factor during the drilling operation.

Currently, most drill string designs are based on an engineer's knowledge of prior drilling operations with additional considerations of the well to be drilled. This often results in the drill string that is selected not being of the optimum design for the conditions under which the well is to be drilled. This lack of adequate design methods often results in improper, or non-optimized drill string assemblies being utilized in drilling operations. Subsequent vibrations that are incurred during the drilling process require the drilling to be operated under less than optimum conditions, limited at least in part, to limiting the stick-slip vibrations to tolerable levels to minimize damage or premature wear of the drill string and associated equipment. The other option at this point, is to pull and change the drill string design to a different design that engineers believe would create less vibrations at the desired drilling conditions. This method of "try and see" is a very costly option resulting in additional equipment costs and lost drilling time.

While the methods in the art provide for surveillance of an existing drill string/drilling operation, they do not provide for an engineering-based method for designing the properties of a drill string assembly that will minimize stick-slip vibrations under proposed well drilling conditions. The art remains in need for such engineering-based, proactive design of drill strings matched to the operating conditions in order to minimize incurred stick-slip vibrations.

SUMMARY

The present disclosure relates to methods for predicting modified drilling operation conditions based on proposed changes to the drill string configuration and/or the drilling parameters. More particularly, included are methods for drilling wells utilizing a method for the selection of modified drill string assemblies and/or modified drilling parameters.

In one embodiment, the subject matter herein includes a method for drilling a wellbore in a subterranean formation, comprising:

a) obtaining initial drilling parameters characterizing an initial drilling operation using an initial drill string that was used to drill a portion of a wellbore or a different wellbore;

b) determining an initial Torsional Severity Estimate ($TSE_{init}$) for at least a portion of the drilling operation;

c) determining a reference value for a theoretical specific surface torque swing at full stick-slip per RPM for the initial drill string ($\Delta TQS_{ref,init}$) for the initial drilling operation;

d) determining at least one modified drill string wherein the modified drill string is different from the initial drill string, at least one modified drilling parameter wherein the modified drilling parameter is different from the initial drilling parameter, or a combination thereof, for a modified drilling operation;

e) determining a reference value for a theoretical specific surface torque swing at full stick-slip per RPM for the modified drill string ($\Delta TQS_{ref,mod}$) for the modified drilling operation;

f) calculating a Torsional Severity Estimate ($TSE_{mod}$) for the modified drilling operation using the at least one modified drill string, the at least one modified drilling parameter, or a combination thereof, using at least one of:

i) a ratio of theoretical specific surface torque swing at full stick-slip per RPM for the initial drill string ($\Delta TQS_{ref,init}$) and the modified drill string ($\Delta TQS_{ref,mod}$);

ii) a ratio of surface rotary speed (SRPM) for the initial drilling operation and the modified drilling operation; or iii) a ratio of downhole torque (DTOR) values for the initial drilling operation and the modified drilling operation;

g) selecting one of the following:

i) the initial drill string and at least one modified drilling parameter, ii) the at least one modified drill string, or iii) the at least one modified drill string and at least one modified drilling parameter; and h) drilling the wellbore in a subterranean formation using a drilling system comprising the selection from step (g).

In another embodiment, the subject matter herein includes a method for drilling a wellbore in a subterranean formation, comprising:

a) obtaining initial drilling parameters characterizing a drilling operation using an initial drill string, wherein the initial drilling parameters include surface torque-swing ($\Delta TQ$), drill string surface rotary speed (SRPM), measured depth (MD), and a theoretical specific surface torque-swing at full stick-slip per RPM ($\Delta TQS_{ref}$) for the initial drill string and for a modified drill string;

b) calculating a distribution of specific surface torque-swing per RPM ($\Delta TQS$) for at least a portion of the drilling operation using the initial drill string and the initial drilling parameters;

c) determining a distribution of specific surface torque-swing per RPM ($\Delta TQS$) for the drilling operation using the initial drill string and modified drilling parameters;

d) determining a distribution of specific surface torque-swing per RPM ($\Delta TQS$) for the drilling operation using the modified drill string and the initial drilling parameters;

e) determining a distribution of specific surface torque-swing per RPM ($\Delta TQS$) for the drilling operation using the modified drill string and the modified drilling parameters;

f) selecting one of the following as the selected drill string and the selected drilling parameters: the initial drill string and the initial drilling parameters from (a and b); the initial drill string with the modified drilling parameters from (c); the modified drill string with the initial drilling parameters from (d); or the modified drill string with the modified drilling parameters from (e), where the selection is based on the distribution of the specific surface torque swing per RPM ($\Delta TQS$) for each of the four cases; and g) drilling a wellbore in a subterranean formation using a drilling system comprising the selected drill string and the selected drilling parameters from step f).

In yet another embodiment, the subject matter herein includes a method for drilling a wellbore in a subterranean formation, comprising:

a) obtaining drilling parameters characterizing a drilling operation using an initial drill string, wherein the drilling parameters include surface torque-swing, drill string surface rotary speed, measured depth, and a theoretical surface torque swing at full stick-slip per RPM ($\Delta TQS_{ref}$) of the initial drill string;

b) calculating a distribution of the specific surface torque-swing per RPM ($\Delta TQS$) for at least a portion of the drilling operation using the initial drill string;

c) selecting a desired value for a theoretical specific surface torque-swing at full stick-slip per RPM ($\Delta TQS_{ref}$) for the drilling operation for a modified drill string design based on the overall distribution of specific surface torque swing data per RPM ($\Delta TQS$) for the drilling operation using the initial drill string;

d) designing a modified drill string based on the desired value for the theoretical specific surface torque-swing at full stick-slip per RPM ($\Delta TQS_{ref}$) for the drilling operation;

e) selecting drilling parameters to operate the modified drill string; and f) drilling a wellbore in a subterranean formation using a drilling system comprising the modified drill string.

In yet another embodiment, the subject matter herein includes a method for drilling a wellbore in a subterranean formation, comprising:

a) obtaining drilling parameters characterizing a drilling operation using an initial drill string, wherein the drilling parameters include specific surface torque-swing per RPM ($\Delta TQS$) and drill string surface rotary speed (SRPM) or drill string bit rotary speed (BRPM), and using the initial drill string;

b) calculating an overall distribution of a Torsional Severity Estimate (TSE) for at least a portion of the drilling operation using the initial drill string;

c) calculating a theoretical specific surface torque-swing at full stick-slip per RPM ($\Delta TQS_{ref}$) for at least one modified drill string;

d) selecting a final drill string from the at least one modified drill string;

e) selecting drilling parameters to operate the modified drill string; and f) drilling a wellbore in a subterranean formation using a drilling system comprising the final drill string.

In yet another embodiment, the subject matter herein includes a method for drilling a wellbore in a subterranean formation, comprising:

a) obtaining drilling parameters characterizing a drilling operation using an initial drill string, wherein the drilling parameters include surface torque-swing ($\Delta TQ$), drill string surface rotary speed (SRPM) or drill string bit rotary speed (BRPM), and measured depth (MD) using the initial drill string;

b) calculating a distribution of a Torsional Severity Estimate (TSE) for at least a portion of the drilling operation using the initial drill string;

c) calculating a distribution of TSE for at least a portion of the drilling operation using at least one selected value for the theoretical specific surface torque-swing at full stick-slip per RPM ($\Delta TQS_{ref}$);

d) selecting or designing a final drill string based on the distribution of TSE for at least a portion of the drilling operation for the at least one selected value for $\Delta TQS_{ref}$; and e) drilling a wellbore in a subterranean formation using a drilling system comprising the final drill string.

In yet another embodiment, the subject matter herein includes a method for drilling a wellbore in a subterranean formation, comprising:

a) obtaining drilling parameters characterizing a drilling operation using an initial drill string, wherein the drilling parameters include surface torque-swing ($\Delta TQ$), drill string surface rotary speed (SRPM) or drill string bit rotary speed (BRPM), and measured depth (MD) using the initial drill string;

b) calculating a distribution of a Torsional Severity Estimate (TSE) for at least a portion of the drilling operation using the initial drill string;

c) calculating a distribution of TSE for at least a portion of the drilling operation using at least one selected value for a the theoretical surface torque-swing at full stick-slip per RPM $\Delta TQS_{ref}$;

d) selecting or designing a final drill string based the distribution of TSE for at least a portion of the drilling operation for the at least one selected value for $\Delta TQS_{ref}$; and e) drilling a wellbore in a subterranean formation using a drilling system comprising the final drill string.

DETAILED DESCRIPTION

Figure 1:
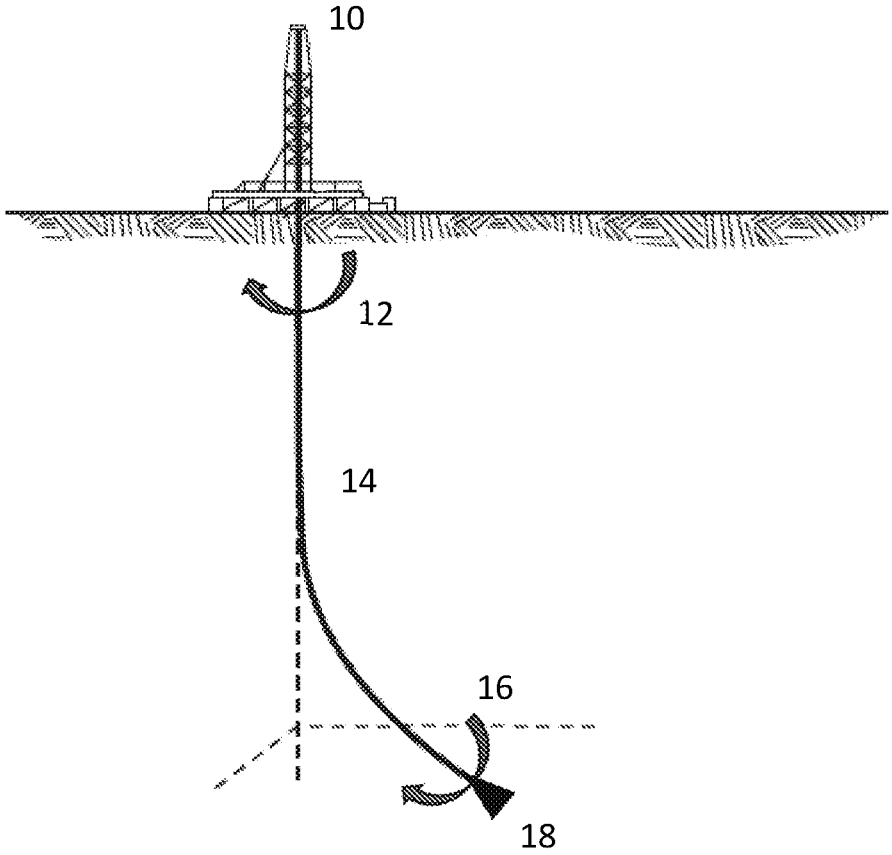
FIG. 1 illustrates a drilling rig at the surface with a drill string, showing torque applied at the surface and at the bit, with rotation of pipe and bit.

In the following Detailed Description, specific aspects and features of the claimed subject matter are described in connection with several exemplary methods and embodiments. However, to the extent that the following description is specific to a particular embodiment or a particular use of the present techniques, it is intended to be illustrative only and merely provides a concise description of exemplary embodiments. Moreover, in the event that a particular aspect or feature is described in connection with a particular embodiment, such aspect or feature may be found and/or implemented with other embodiments of the present invention where appropriate. Accordingly, the claimed invention is not limited to the specific embodiments described below, but rather, the invention includes all alternatives, modifications, and equivalents falling within the scope of the appended numbered paragraphs and claimed subject matter.

Definitions of some of the terms utilized herein are as follows:

The term "drill string assembly" (or "drill string" or "drilling assembly") refers to a collection of connected tubular components that are used in drilling operations to drill a hole through a subterranean formation. Exemplary components that may collectively or individually be considered a part of the drill string include rock cutting devices such as drill bits, mills and reamers; bottom hole assemblies; drill collars; drill pipe; cross overs; subs, stabilizers; roller reamers; MWD (Measurement-While-Drilling) tools; LWD (Logging-While-Drilling) tools; etc.

The term "subterranean formation" refers to a body or section of geologic strata, structure, formation, or other subsurface solids or collected material that is sufficiently distinctive and continuous with respect to other geologic strata or other characteristics that it can be mapped, for example, by seismic techniques. A formation can be a body of geologic strata of predominantly one type of rock or a combination of types of rock, or a fraction of strata having a substantially common set of characteristics. A formation can contain one or more hydrocarbon-bearing subterranean formations. Note that the terms formation, hydrocarbon-bearing subterranean formation, reservoir, and interval may be used interchangeably, but may generally be used to denote progressively smaller subsurface regions, zones, or volumes. More specifically, a geologic formation may generally be the largest subsurface region; a hydrocarbon reservoir or subterranean formation may generally be a region within the geologic formation and may generally be a hydrocarbon-bearing zone, a formation, reservoir, or interval having oil, gas, heavy oil, and any combination thereof. An interval or production interval may generally refer to a sub-region or portion of a reservoir. A hydrocarbon-bearing zone, or production formation, may be separated from other hydrocarbon-bearing zones by zones of lower permeability such as mudstones, shales, or shale-like (highly compacted) sands. In one or more embodiments, a hydrocarbon-bearing zone may include heavy oil in addition to sand, clay, or other porous solids.

The term "drilling operation" refers to the process of creating a subterranean wellbore passing through various subterranean formations for the purpose of subsurface mineral extraction. A drilling operation is conducted using a drilling rig, which raises and lowers a drill string composed of joints of tubular components of various sizes. A drill bit is located at the end of the drill string which is used to penetrate the subterranean formations by mechanisms of crushing and/or slicing the rock. The power required to advance the drill bit is provided by motors which rotate the drill pipe and lower the drilling assembly and mud pumps which allow the drilling fluid to be conveyed through the drilling assembly and back up the annulus. A drilling operation typically proceeds on a section by section basis with each section designated as a "hole section". A drilled well typically possesses a number of hole sections which may include a conductor hole section, a surface hole section, various intermediate hole sections and a production hole section. A drilled well will sometimes include one or more "side tracks" where a side track is a secondary wellbore drilled away from an original wellbore typically to bypass an unusable original wellbore section. An "offset well" refers to a well that is within some proximity of a well of interest, however herein there is no distinction between a section of an offset well and a previously drilled section of the same well as both provide historical drilling parameters that may be analyzed to determine a drilling parameter set for a future drilling interval.

The term "drilling parameters" refers to measurable physical or operational parameters of the drilling operations and/or the drilling equipment, as well as parameters that can be calculated therefrom and are useful information in monitoring, operating, or predicting aspects of drilling operations. Drilling parameters include, but are not limited to, TSE, $TSE_{TQ}$, $TSE_{BRPM}$, TQ, ΔTQ, $\Delta TQ_{SS}$, ΔTQS, $\Delta TQS_{ref}$, T, SRPM, BRPM, MD, WOB, DTOR, D, and μ, all of which are further defined and described herein.

The term Torsional Severity Estimate or "TSE" refers to an estimate of the magnitude of angular (or rotational) vibrations of a drilling assembly near the drill bit or above the downhole mud motor (in the event that a mud motor is one of the components of the drilling assembly). By definition, a TSE value of zero is indicative of no rotational (angular) vibrations. A TSE value of 1 denotes a full stick-slip state of the drilling assembly, a harmonic condition of the drilling assembly characterized by the bit periodically coming to a stop instantaneously and then accelerating to an angular velocity that is twice the rotary speed applied at the surface. TSE values above 1 are associated with severe stick-slip conditions which may be associated with bit "stuck-time" or even backwards rotation of the bit. TSE may be estimated from measurements taken by downhole sensors or measurements taken from sensors instrumented on surface equipment used in conjunction with a mechanics model of the drilling assembly. It is important to note that TSE may be normalized in other equivalent ways, for example as a percentage of the full stick-slip condition.

The term "$TSE_{TQ}$" refers to a Torsional Severity Estimate (TSE) that has been obtained using data from sensors instrumented on surface equipment and a mechanics model of the drilling assembly. The mechanics model of the drilling assembly is a physics based mathematical model that provides a relationship between fluctuations in the downhole rotary speed of the drilling assembly and fluctuations in the surface torque. In at least one such model, the RPM of the drilling assembly that is obtained at the surface for the drilling operations (i.e., at or near the rotary drive system) is an input parameter.

The term "$TSE_{BRPM}$" refers to a Torsional Severity Estimate (TSE) that has been obtained from measurements taken by sensors located on downhole equipment. The sensors and downhole equipment may directly record downhole rotary speed and/or minimum and maximum downhole rotary speed. These quantities along with either the surface rotary speed or average rotary speed as measured by the downhole sensors may be used to evaluate TSEBRPM without the need for a mechanics model of the drilling assembly.

FIG. 1 illustrates a drilling rig (10) at the surface with a drill string (14), showing torque applied at the drilling rig or surface (10) and at the bit (18), with rotation at the surface of the drill string (12) and rotation at the bit (16). In an embodiment, a well or a portion of an existing well is drilled at the location of the well bore site, or an offset well is drilled in the vicinity of the proposed well bore site. Offset wells are often utilized to provide information of the subsurface geology and conditions for the planning and design of a well bore. Offset wells may be wells that are drilled specifically for the planning of a well bore design or may be existing operating, or prior operating wells in the vicinity of the proposed well bore site from which the subsurface geology and conditions for proposed well bore site can be obtained. Similarly, data may be used as obtained from prior drilling of the proposed well bore site or previously obtained from existing offset well(s).

Drilling RPM speeds, bit weight, bit type, torque data, and drill string configuration may be obtained from the drilling of the offset wells. These offset wells may provide valuable data if similar in design and configuration to a proposed new drill well. In particular, the data may be analyzed to understand the stick-slip vibrations and quantitatively evaluate means to mitigate these vibrations as disclosed herein.

In the present method, the following information may be taken at various times (and optionally depths) during the offset well drilling operation. Some of the terms as utilized herein are:

TSE=Torsional Severity Estimate.

$TSE_{TQ}$=Torsional Severity Estimate based on torque swing data or modeling.

$TSE_{BRPM}$=Torsional Severity Estimate based on drill bit RPM (BRPM) data or modeling.

TQ=the measured drill string surface torque.

ΔTQ=the surface torque-swing over one periodic stick-slip cycle.

$\Delta TQ_{SS}$=the theoretical surface torque-swing at full stick-slip, which is a function of RPM.

ΔTQS=the specific surface torque-swing per RPM (ΔTQ/SRPM).

$\Delta TQS_{ref}$=the theoretical specific surface torque-swing at full stick-slip per RPM for a drill string at a measured bit depth.

T=the theoretical stick-slip period for a drill string at a measured bit depth.

SRPM="Surface RPM"—the rotary speed of the drill string as measured at the surface in revolutions per minute.

BRPM="Bit RPM"—the rotary speed of the drill bit as measured at the drill bit in revolutions per minute.

MD=the measured bit depth.

WOB="Weight on Bit"—the applied load along the axis of the bit.

DTOR="Downhole Torque"—the applied torque, which may include components of bit torque, downhole motor torque, and/or pipe friction from rubbing against the borehole wall, as appropriate.

D=Diameter of the wellbore being drilled.

μ"Bit Friction Factor"—dimensionless friction factor for the bit (defined as "bit torque/3*WOB*D").

A non-dimensional stick-slip estimate (or Torsional Severity Estimate—TSE) may be determined from the surface torque swing data, the reference specific torque swing value, and surface RPM as follows:

$$TSE_{TQi} = \frac{\text{Torque Swing } \Delta TQi}{\Delta TQS_{ref} \cdot \text{Average}(SRPM_i)} \quad \text{(Eq. 1)}$$

where i is a sampling index associated with time-based data measurements and calculated quantities which depend on time-based data measurements. The quantities "Torque Swing $\Delta TQ_i$" and "Average($SRPM_i$)" represent estimates of the surface torque swing (i.e., maximum surface torque minus surface minimum torque) and the average Surface RPM (SRPM) over a time window $\Delta t_i = t_i - t_{i-P}$ (for some integer P>1), where $t_i$ is the time associated with sample index i. The time window is taken to be some value greater than or equal to the theoretical stick-slip period T of the drilling assembly and is a function of the measured bit depth MD. "Torque $Swing_i$" may be evaluated in a number of different ways including:

$$\text{Torque Swing } \Delta TQ_i = \max(TQ_i, TQ_{i-1}, \ldots TQ_{i-P}) - \min(TQ_i, TQ_{i-1}, \ldots TQ_{i-P}) \quad \text{(Eq. 2)}$$

Other methods for evaluating "Torque Swing $\Delta TQ_i$" are also possible. For example there are methods reported in the literature for evaluating "Torque Swing $\Delta TQ_i$" in a manner that removes trends in the mean value of the surface torque signal to handle cases where the mean value is increasing or decreasing (see U.S. Pat. No. 8,977,523). The term "Average ($SRPM_i$)" may also be evaluated in a number of different ways including:

$$\text{Average}(SRPM_i) = \text{median}(SRPM_i, SRPM_{i-1}, \ldots, SRPM_{i-P}) \quad \text{(Eq. 3)}$$

$$\text{Average}(SRPM_i) = \text{avg}(SRPM_i, SRPM_{i-1}, \ldots, SRPM_{i-P}) \quad \text{(Eq. 4)}$$

$$\text{Average}(SRPM_i) = SRPM_j \quad \text{(Eq. 5)}$$

where $i-P=\leq j \leq i$. In this disclosure, references to Average (SRPM) may refer to any of the above forms for an interval average, i.e. Eq. 3, 4, or 5. The above formulas constitute windowed calculations involving the measured surface torque TQ and Surface RPM (SRPM). Other methods for evaluating "Torque $Swing_i$" and "Average($SRPM_i$)" are also possible and are known to one skilled in the art and are described in more detail in U.S. Pat. No. 8,977,523 which is incorporated herein by reference.

The quantity $\Delta TQS_{ref}$ is the theoretical specific surface torque swing (i.e., max surface torque minus min surface torque over a stick-slip cycle) at full stick-slip per Surface RPM. The parameters T and $\Delta TQS_{ref}$ are quantities that may be evaluated by a drilling mechanics model and depend on drill string component geometry, drilling fluid rheology and measured bit depth (MD). One drilling mechanics model to determine $\Delta TQS_{ref}$ is described in detail in U.S. Pat. No. 8,977,523 which is incorporated herein by reference. Another related reference is SPE Paper 163420, published as a Drilling & Completions journal article: Ertas, D., Bailey, J. R., Wang, L., & Pastusek, P. E. (2014, Dec. 1). *Drillstring Mechanics Model for Surveillance, Root Cause Analysis, and Mitigation of Torsional Vibrations. Society of Petroleum Engineers*. doi: 10.2118/163420-PA.

Although the model disclosed above is an exemplary dynamic drill string model, comprising a frequency-domain wave equation solution to the equations of motion, there are other models that could fall within the scope of a dynamic model for these purposes. For example, the use of a simple single-element spring model might be adequate, or alternatively, a model that includes spring, mass, and/or damping elements. Time domain modeling might also be used to calculate the torque swing at full stick-slip, yielding values for $\Delta TQS_{ref}$ when normalized by SRPM.

Alternatively, $\Delta TQS_{ref}$ may be estimated if both surface and downhole data are available for the offset well. An analysis of the TSE data from the downhole data and the calculated specific surface torque swing data may be used to estimate the reference value $\Delta TQS_{ref}$ at the full stick-slip condition. Furthermore, this estimate may be performed at multiple bit depths to approximate $\Delta TQS_{ref}$ as the drill string assembly length changes.

The quantity TSE is an estimate of the excitation of the primary torsional mode of the drilling assembly and provides a measure of torsional dysfunction for a drilling operation. This parameter is normalized such that a value of 0 indicates no torsional vibrations and a value of 1 denotes full stick-slip (a condition characterized by the drill bit periodically coming to an instantaneous stop). For severe stick-slip it is possible for TSE to become much greater than a value of 1. TSE can be used to further estimate the minimum and maximum bit RPM (BRPM) as follows:

$$BRPM_i^{min}=\max[(1-TSE_i)\cdot Average(SRPM_i),0] \quad \text{(Eq. 6)}$$

$$BRPM_i^{max}=(1+TSE_i)\cdot Average(SRPM_i) \quad \text{(Eq. 7)}$$

In Equation 6 it is assumed that the drill bit does not rotate backwards; however, this assumption can be relaxed. Field data obtained from sensors instrumented on surface equipment of a drilling assembly for an offset well may be processed to determine torsional dysfunction. Torsional dysfunction may be characterized using TSE and/or the calculated "actual surface torque-swing" ΔTQ, where actual surface torque swing may be defined as:

$$\Delta TQ_i=\max(TQ_i,TQ_{i-1}, \ldots ,TQ_{i-P})-\min(TQ_i,TQ_{i-1}, \ldots ,TQ_{i-P}) \quad \text{(Eq. 8)}$$

The "theoretical surface torque-swing at full stick-slip" $\Delta TQ_{ss}$ is defined as follows for an interval of length P with rotary speed SRPM:

$$\Delta TQ_{SSi}=\Delta TQS_{ref}\cdot Average(SRPM_i,SRPM_{i-1}, \ldots ,SRPM_{i-P}) \quad \text{(Eq. 9)}$$

This quantity estimates the theoretical torque-swing at the surface when the drill bit is experiencing a state of full stick-slip. In other words (under the assumptions of the drilling mechanics modeling techniques referenced in the Background section) the value of $\Delta TQ_{SS}$ should equal the value for ΔTQ whenever the drilling assembly is in a state of full stick-slip at surface rotary speed SRPM. When the surface RPM is relatively constant and $\Delta TQ_{ref}$ may be a weakly-varying function of measured depth MD, the value for the theoretical surface torque-swing at full stick-slip $\Delta TQ_{SS}$ is essentially constant. As discussed above, a $TSE_{TQ}$ value of 1 denotes that the drill string is at "full stick-slip" (a condition characterized by the drill bit periodically coming to an instantaneous stop). For $TSE_{TQ}$ values above 1, the drill string is in "severe stick-slip". Extended operations (or high percentage of operating time) of $TSE_{TQ}$ values above 1 may result in reduced bit and drill string life, mechanical damage, or mechanical failure. Therefore, it would be beneficial to the art if one could make a calculated estimate of the changes in the $TSE_{TQ}$ that a modified drill string would experience based on data from an existing well.

Drill bit RPM (BRPM) data may be available as a time series in an offset well drilling operation using an initial drill string. These BRPM measurements are typically obtained from down-hole instrumentation located in the drill string, preferably at or near the drill bit and received and recorded using data transmission devices and methods known in the art. Alternatively, this data may be recorded in "memory mode" for later retrieval at the surface. The TSE distribution obtained from the BRPM data using the initial drill string can be calculated using Equation 10. We herein denote the calculation method for determining the TSE in this embodiment as $TSE_{BRPM}$ (Torsional Severity Estimate based on BRPM data or modeling) to differentiate from the method above for determining $TSE_{TQ}$ (Torsional Severity Estimate based on torque swing and rotary speed data and a physical model). The average BRPM must equal the average SRPM over suitably long time intervals for there to be no net angular distortion of the drill string.

$$TSE_{BRPMi}=\frac{\max(BRPM_i, BRPM_{i-1}, \ldots , BRPM_{i-p})-\text{Average}(BRPM_i, BRPM_{i-1}, \ldots , BRPM_{i-p})}{\text{Average}(BRPM_i, BRPM_{i-1}, \ldots , BRPM_{i-p})} \quad \text{(Eq. 10)}$$

where i is a sampling index associated with time-based RPM data measurements. The above formula amounts to performing windowed calculations involving the measured RPM, where the time window $\Delta t_i=t_i-t_{i-P}$ (for some integer P>1) is taken to be some value greater than the theoretical stick-slip period T of the drilling assembly. In some instances, a calculation similar to this may be performed by downhole electronics and the resulting $TSE_{BRPM}$ value calculated directly by the vendor, perhaps without even storing the bit RPM data.

Using the $TSE_{BRPM}$ distribution from the Well 1 data, the $\Delta TQS_{ref,init}$ of the initial drill string, and the $\Delta TQS_{ref,mod}$ of a proposed (i.e. "modified") drill string, a new $TSE_{BPM}$ distribution can be estimated for the modified drill string using Equation 11.

$$TSE_{BRPM\ modi}=TSE_{BRPM\ initi}\cdot\frac{\Delta TQS_{ref,init}}{\Delta TQS_{ref,mod}} \quad \text{(Eq. 11A)}$$

where $TSE_{BRPM\ init\ i}$=Torsional Severity Estimate based on BRPM of the initial drill string for sampling index i.

$TSE_{BRPM\ mod\ i}$=Torsional Severity Estimate based on BRPM of the modified drill string for sampling index i.

$\Delta TQS_{ref,\ init}$=the theoretical surface torque-swing at full stick-slip per BRPM for the initial drill string at a measured bit depth.

$\Delta TQS_{ref,\ mod}$=the theoretical surface torque-swing at full stick-slip per BRPM for a modified drill string at a measured bit depth.

Although Equation 11A is specific to the case where TSE is evaluated based on downhole RPM data ($TSE_{BRPM}$), a similar equation may also be constructed based on the surface torque data ($TSE_{TQ}$) as shown in Equation 11B.

$$TSE_{TQ\ modi}=TSE_{TQ\ initi}\cdot\frac{\Delta TQS_{ref,init}}{\Delta TQS_{ref,mod}} \quad \text{(Eq. 11B)}$$

where $TSE_{TQ\ init\ i}$=Torsional Severity Estimate based on torque swing of the initial drill string for sampling index i.

$TSE_{TQ\ mod\ i}$=Torsional Severity Estimate based on torque swing of the modified drill string for sampling index i.

$\Delta TQS_{ref,\ int}$=the theoretical surface torque-swing at full stick-slip per BRPM or SRPM for the initial drill string at a measured bit depth.

$\Delta TQS_{ref,\ mod}$=the theoretical surface torque-swing at full stick-slip per BRPM or SRPM for a modified drill string at a measured bit depth.

In addition to designing or selecting alternate drill string designs based on TSE data from an initial drill string, the methods herein can also be utilized to select and modify additional drilling parameters based on the TSE and/or the Torque Swing information obtained from the initial drill string operation.

These additional drilling parameters may include modifying the SRPM of the drill string, the bit coefficient of friction (μ), the Weight-On-Bit (WOB), the wellbore diameter (D) and/or other sources of downhole torque. The relationships are shown here and it is clear to one of skill in the art that these can be used individually or in any combination to modify the operational parameters for either the initial drill string or a modified drill string using the following equations. If the revised drilling parameters are to be selected for a modified drill string design, then the TSE for the initial drill string and the modified drill string can be calculated by the various methods previously described herein and inserted into the formulas to determine one or more desired drilling parameters. A revised set of drilling parameters may be selected for the initial drill string design, with no modifications to the drill string design, then the information obtained from drilling a well with the initial drill string may be used to determine one or more modified drilling parameters for subsequent use of the initial drill string.

From Equation 1, the following equation can be developed.

$$TSE_{mod} = TSE_{init} \cdot \frac{\Delta TQS_{ref\ init}}{\Delta TQS_{ref\ mod}} \cdot \frac{SRPM_{init}}{SRPM_{mod}} \cdot \frac{\mu_{mod} \cdot WOB_{mod} \cdot D_{mod}}{\mu_{init} \cdot WOB_{init} \cdot D_{init}} \quad \text{(Eq. 12)}$$

There are some downhole drilling tools that measure torque very near the bit. When using downhole torque data, there may not be a need to reference the "μ*WOB*D" term used above. In deviated and horizontal wells, there are additional sources of downhole torque such as friction between the pipe and borehole wall and the use of downhole motors. These values may be measured, modeled, or a combination of measured and modeled values. Those skilled in the art have knowledge of torque and drag friction models and their application to extended-reach wells. Wherein the term DTOR may include components of bit torque, motor torque, and/or pipe friction sources of downhole torque, this equation becomes:

$$TSE_{mod} = TSE_{init} \cdot \frac{\Delta TQS_{ref\ init}}{\Delta TQS_{ref\ mod}} \cdot \frac{SRPM_{init}}{SRPM_{mod}} \cdot \frac{DTOR_{mod}}{DTOR_{init}} \quad \text{(Eq. 13)}$$

Having the drilling data for the initial drill string (designated with "init" subscript), this relationship can be used to project a $TSE_{mod}$ by modifying any combination or all of the variables (i.e., $\Delta TQS_{ref\ mod}$, $SRPM_{mod}$, $\mu_{mod}$, $WOB_{mod}$, $D_{mod}$, and/or $DTOR_{mod}$). Similarly, this equation may be used by substituting the downhole data where applicable in Equations 10 and 11 herein. Additionally, if no change in the drill string configuration is made, the $\Delta TQS_{ref}$, and the "modified" values can be used to predict changes required in rotary speed and downhole torque sources utilizing the same drill string.

In one of these embodiments, an optimized modified SRPM can be determined for either the initial drill string or a modified drill string. Equation 9 for the initial drill string can be utilized as follows (designated with the subscript "init"):

$$\Delta TQ_{ss\ init} = \Delta TQS_{ref,init} \cdot \text{Average}(SRPM_{init}) \quad \text{(Eq. 14)}$$

Dividing Equation 14 with the $\Delta TQ_{SS\ mod}$ equation for the modified drill string, this formula becomes:

$$\Delta TQ_{SS\ mod} = \Delta TQ_{SS\ init} \cdot \frac{\Delta TQS_{ref\ mod} \cdot \text{Average}(SRPM_{mod})}{\Delta TQS_{ref\ init} \cdot \text{Average}(SRPM_{init})} \quad \text{(Eq. 15)}$$

From this equation, it is clear that one can calculate a revised SPRM operating parameter Average($SRPM_{mod}$) based on the drilling information from the initial drill string, the $\Delta TQS_{ref}$ of the initial and modified drill strings, and a desired $\Delta TQ_{SS}$ of the modified drill string. It should be noted that this equation is further simplified to allow for the calculation of a revised SPRM drilling parameter of the initial drill string based on the drilling information from the initial drill string, and a desired $\Delta TQ_{SS}$ of the initial drill string under modified SRPM conditions. Here, since the $\Delta TQS_{ref}$ values in Equation 1 are both for the initial drill string, this value drops out of both the numerator and denominator to simplify as follows (where subscript "init 1" refers to the initial drill string parameters, as measured or based on actual drilling measurements and subscript "init 2" refers to the initial drill string with proposed modified drilling parameters):

$$\Delta TQ_{SS\ init\ 2} = \Delta TQ_{SS\ init\ 1} \cdot \frac{\text{Average}(SRPM_{init\ 2})}{\text{Average}(SRPM_{init\ 1})} \quad \text{(Eq. 16)}$$

From this equation, it is clear that one can calculate a revised SPRM operating parameter Average($SRPM_{init\ 2}$) for the initial drill string based on a desired value for $\Delta TQ_{SS}$ for the revised drilling operations. One may also use the "Average(BRPM)" in place of the "Average(SRPM)" data in Equation 16 if so desired.

Additionally, the change in the bit torque is a linear function of the product of the drill bit coefficient of friction (μ), the Weight-On-Bit (WOB) and the wellbore diameter (D). As such for a given drill string, Equation 1 at constant SRPM becomes:

$$TSE_{TQi} = \frac{\text{Torque Swing } \Delta TQi}{\Delta TQS_{ref} \cdot \text{Average}(SRPM_j)} \quad \text{(Eq. 17)}$$

$$TSE_{TQ\ init\ 2} = TSE_{TQ\ init\ 1} \cdot \frac{\mu_{init\ 2} \cdot WOB_{init\ 2} \cdot D_{init\ 2}}{\mu_{init\ 1} \cdot WOB_{init\ 1} \cdot D_{init\ 1}} \quad \text{(Eq. 18)}$$

From this equation, it is clear that one can calculate a revised drill bit coefficient of friction operating parameter ($\mu_{init2}$), a revised Weight-On-Bit ($WOB_{init2}$), and/or a revised wellbore diameter ($D_{init2}$) for the initial drill string based on a desired value for $TSE_{TQ}$ for the revised drilling operations. More torque at the bit increases $TSE_{TQ}$, and less torque reduces $TSE_{TQ}$.

Herein described is a method for selecting the properties of a drill string and associated operating parameters for drilling a well bore with a drill string assembly in a subterranean formation based on reducing or optimizing the amount and/or magnitude of stick-slip vibrations experienced by the drill string assembly under the well bore drilling operations conditions. That is, the method includes procedures for selecting drill string properties and associated drilling parameters for drilling a wellbore in a subterranean formation to reduce or optimize torsional vibrations, based on analysis of field data obtained from the offset drilling operation using the offset drill string design and torsional vibration characteristics to determine a proposed (or "modified") drill string.

The essence of the inventive method is to estimate the change in the torsional vibration data distribution (the TSE) as drill string properties and operating parameters are modified, such that the amount of expected torsional vibrations in the "full stick-slip" condition may be calculated. By quantifying how much full stick-slip remains in the modified condition, it may be determined if this is acceptable or if further redesign is required. Thus field drilling experience may be captured and used quantitatively in an iterative fashion to achieve improved drilling performance.

The torsional vibration state of a drill string may be considered acceptable if it is not in full stick-slip vibration. In most cases, lower torsional vibration amplitudes are preferred, but once the system reaches the state of full stick-slip then one may say that a critical state of drilling dysfunction has been encountered. Therefore, the inventive methods are based upon the application of the TSE transformation equations presented above to render the modified $TSE_{mod}$ distribution to have a low probability (P-value) of exceeding a value of 1, based upon the initial $TSE_{init}$ distribution from an offset well or prior drilling interval.

While the present techniques of the invention may be susceptible to various modifications and alternative forms, the exemplary embodiments discussed above have been illustrated by way of example. However, it should again be understood that the invention is not intended to be limited to the particular embodiments disclosed herein. Illustrative, non-exclusive, examples of descriptions of some systems and methods within the scope of the present disclosure are presented in the following numbered paragraphs. The preceding paragraphs are not intended to be an exhaustive set of descriptions, and are not intended to define minimum or maximum scopes or required elements of the present disclosure. Instead, they are provided as illustrative examples, with other descriptions of broader or narrower scopes still being within the scope of the present disclosure. Indeed, the present techniques of the invention are to cover all modifications, equivalents, and alternatives falling within the spirit and scope of the description provided herein.

EXAMPLE

Figure 2A:
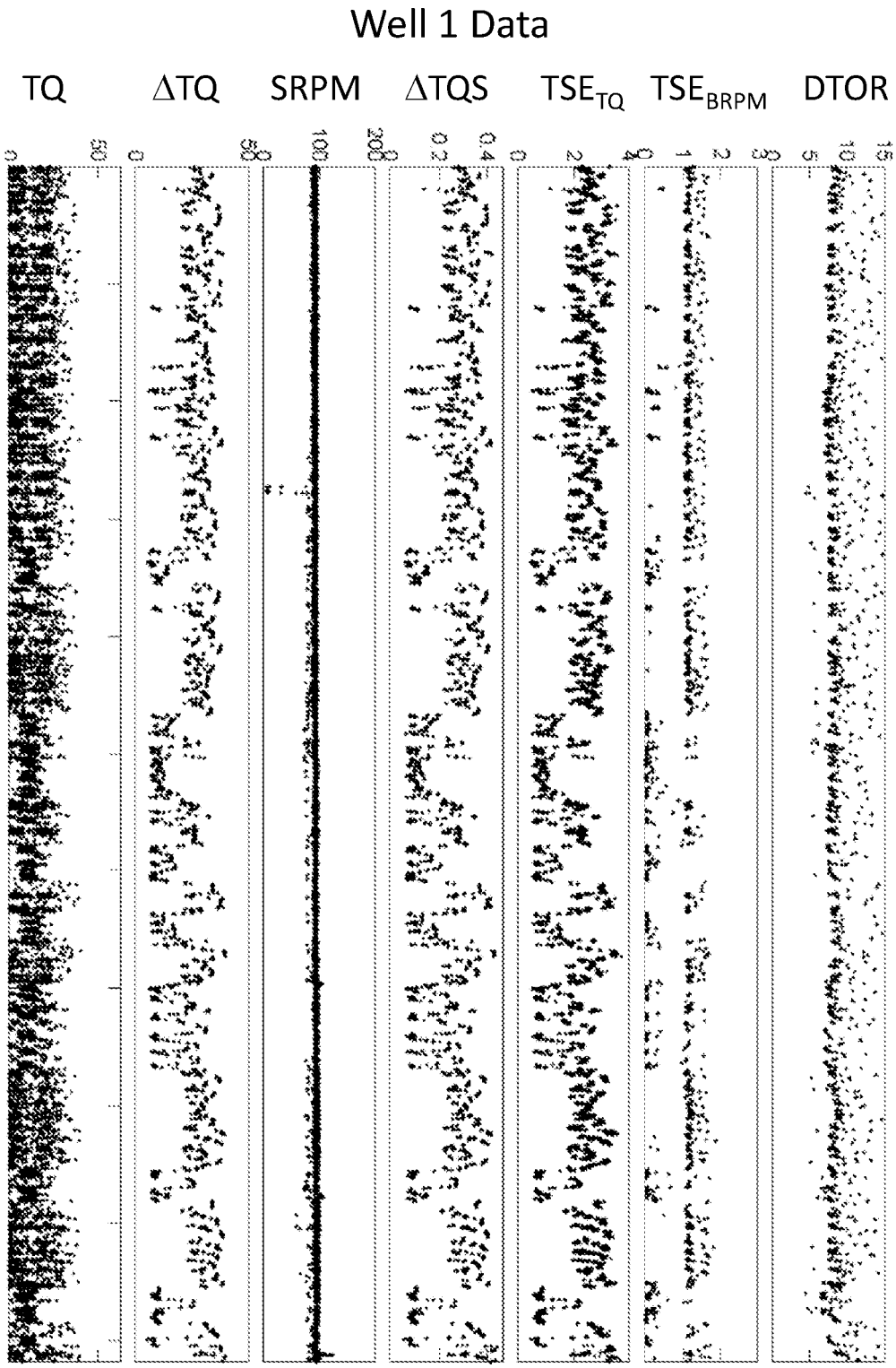
FIG. 2A provides recorded drilling data and calculated values as described herein for a drilling interval in Well 1.
Figure 2B:
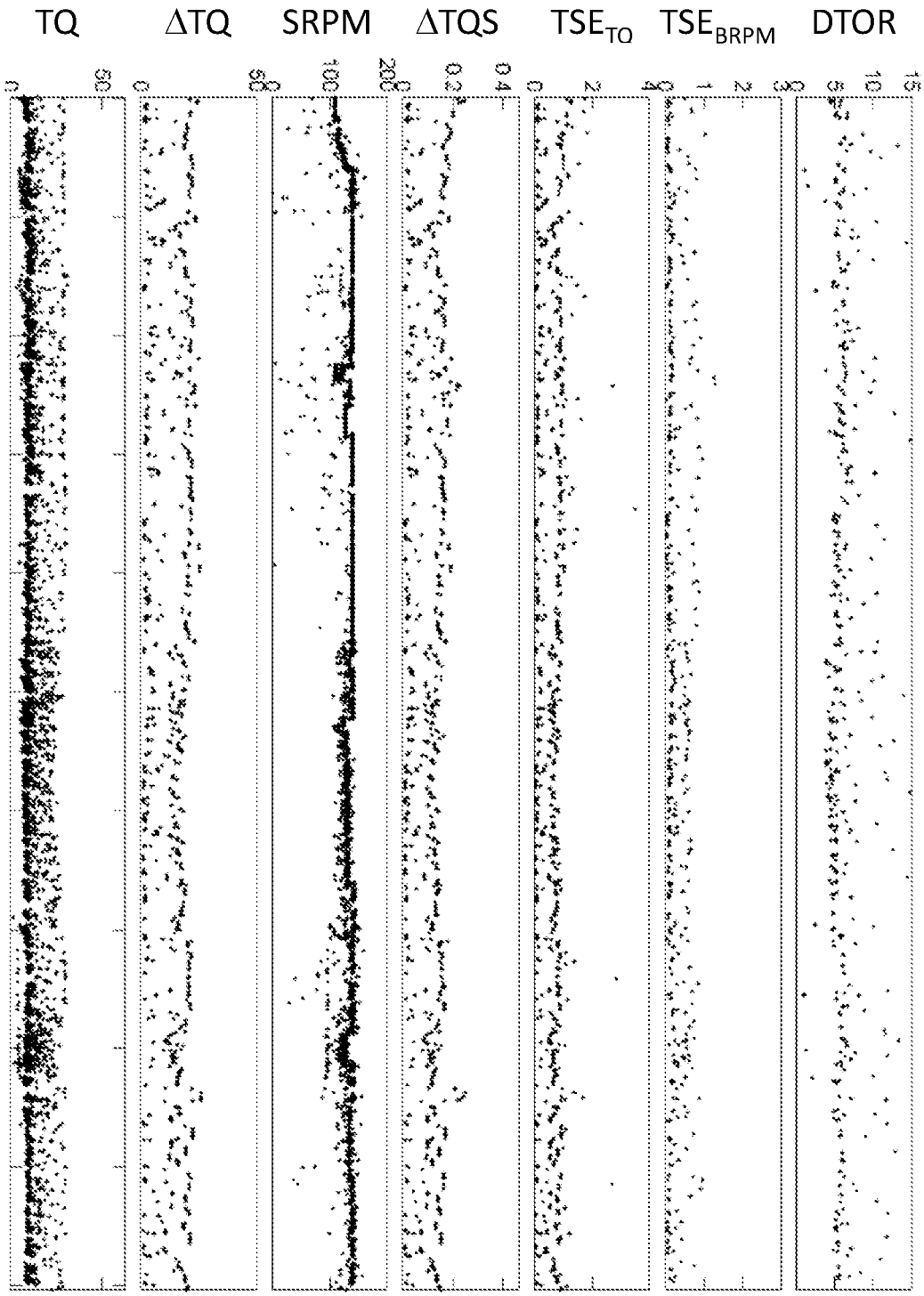
FIG. 2B provides recorded drilling data and calculated values as described herein for a drilling interval in Well 2.

The methodologies described herein may be illustrated using data from two wells. FIGS. 2A and 2B provide raw drilling data and calculated values related to torsional vibrations seen in two drill wells, henceforth referred to as Well 1 and Well 2. The parameter nomenclature for the data as shown in FIGS. 2A and 2B is the same as for the drilling parameters with similar designations as described herein. The torsional vibrations were severe in Well 1 and significantly mitigated in Well 2, as seen in subsequent charts and discussed further herein.

Figure 3:
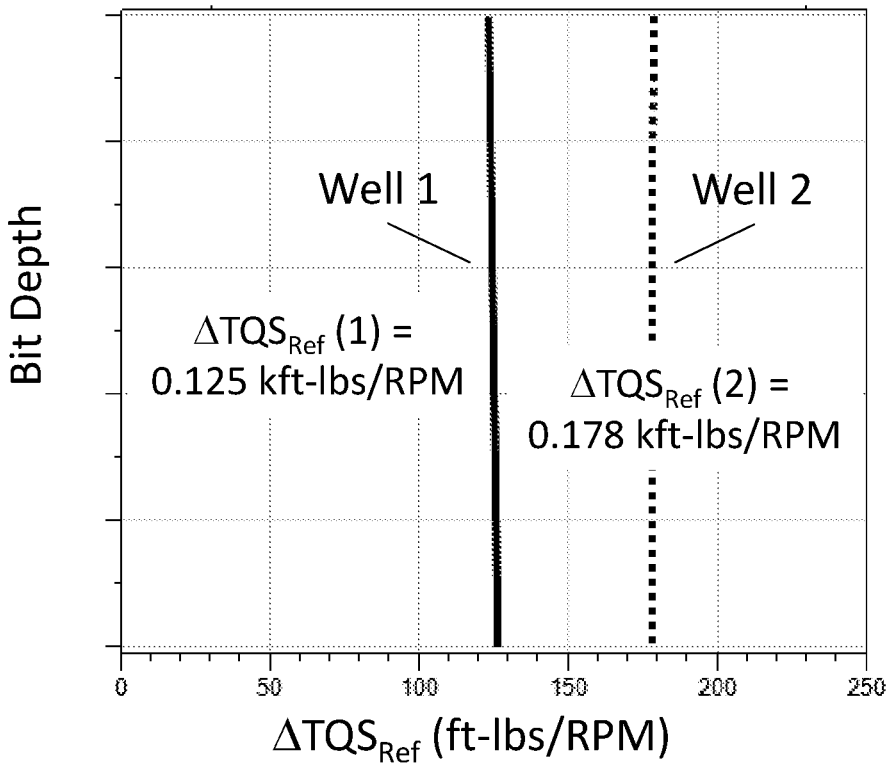
FIG. 3 provides calculated model results for the $\Delta TQS_{ref}$ values for the drill strings for Wells 1 and 2 in the Examples section.

The drill strings for the data provided in FIGS. 2A and 2B are shown in Tables 1A and 1B. From this data, the referenced drilling mechanics model, disclosed in U.S. Pat. No. 8,977,523 and further discussed in SPE 163420 as described above, may be applied to these two drill strings. FIG. 3 illustrates the results of this drill string dynamic model for the two drill strings. The $\Delta TQS_{ref}$ values are 0.125 kft-lbs/RPM for Well 1 and 0.178 kft-lbs/RPM for Well 2, representing a 42% increase in effective drill string torsional stiffness in Well 2.

TABLE 1A

Drillstring 1 Design Information

| Item/Component | OD (inches) | ID (inches) | Length (feet) |
|---|---|---|---|
| 6-5/8 DP | 6.625 | 5 | 6000 |
| 5-7/8 DP | 5.875 | 5.05 | 5553 |
| 5-7/8 HWDP | 5.875 | 3.875 | 552 |
| 6-5/8 HWDP | 6.625 | 4.5 | 125 |
| Collars | 8.25 | 3.0 | 68 |
| Collars | 9.5 | 3.0 | 375 |

TABLE 1B

Drillstring 2 Design Information

| Item/Component | OD (inches) | ID (inches) | Length (feet) |
|---|---|---|---|
| 6-5/8 DP | 6.625 | 5.375 | 11500 |
| 6-5/8 HWDP | 6.625 | 4.5 | 627 |
| Collars | 8.25 | 3.0 | 68 |
| Collars | 9.0 | 3.0 | 175 |

Figure 4A:
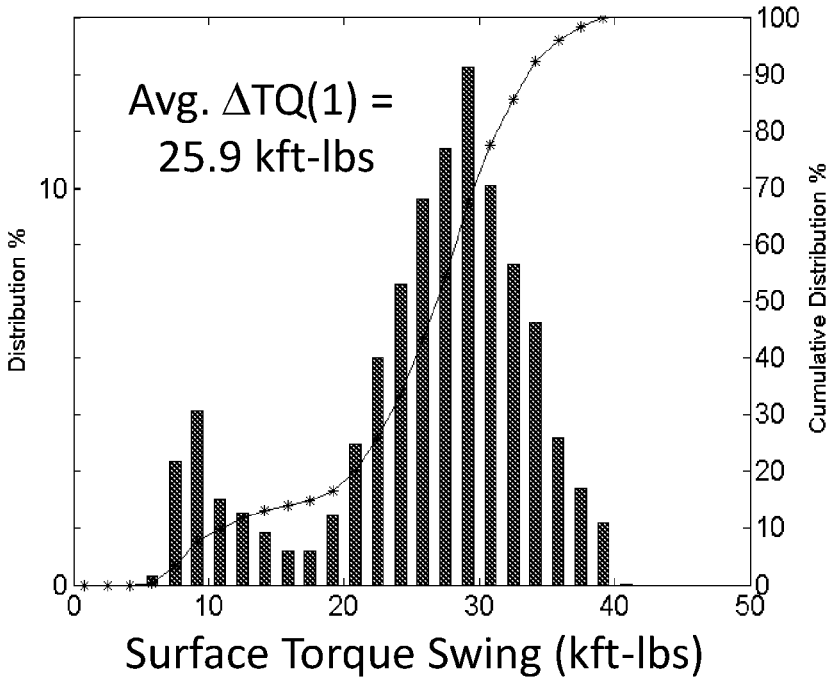
FIG. 4A illustrates the surface torque swing distribution for Well 1.
Figure 6A:
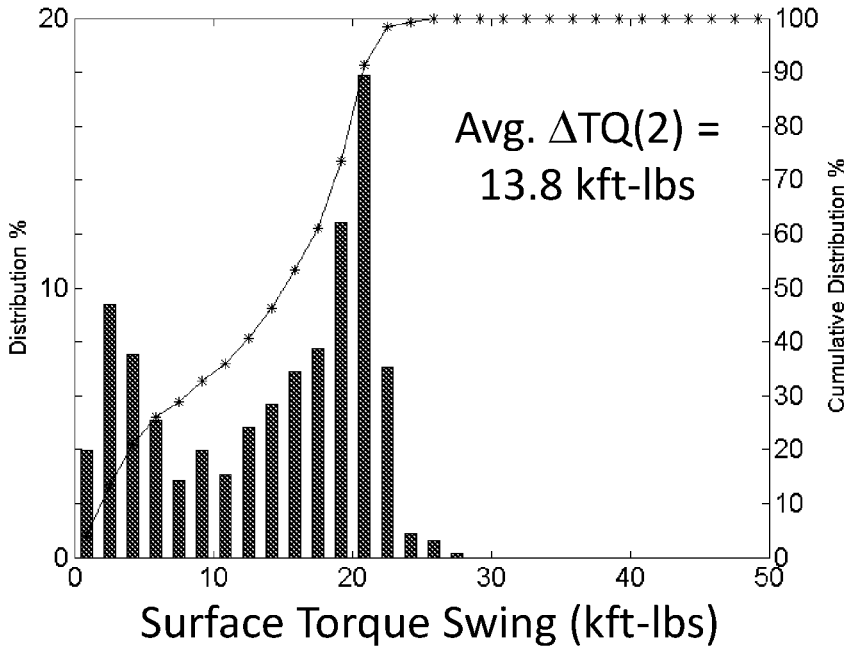
FIG. 6A illustrates the surface torque swing data for Well 2.

Where:
DP=Drill pipe
HWDP=Heavy-weight drill pipe
OD=Outer diameter
ID=Inner diameter FIGS. 4A and 6A show distributions (i.e., bar graphs) of the surface torque-swing using data for the two wells from FIGS. 2A and 2B, respectively. In the distribution charts, the cumulative distributions are also shown as curves with asterisks. For example, in FIG. 4A, it can be seen from the data that the probability (or "P-value") of torque swing in Well 1 exceeding 30 kft-lbs is about 0.3, and the P-value of exceeding 40 kft-lbs is practically zero.

Figure 4B:
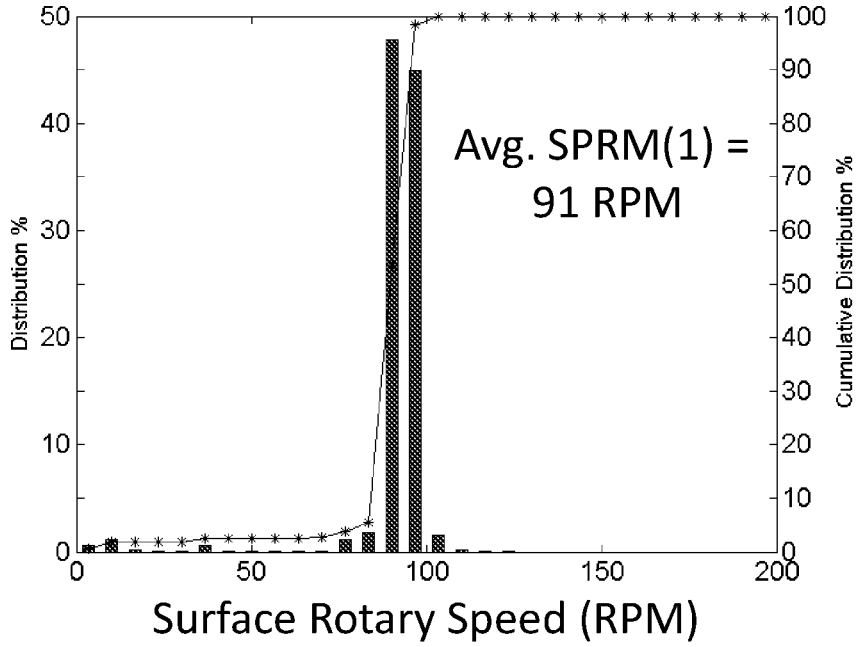
FIG. 4B shows the surface rotary speed (RPM) distribution for Well 1.
Figure 4C:
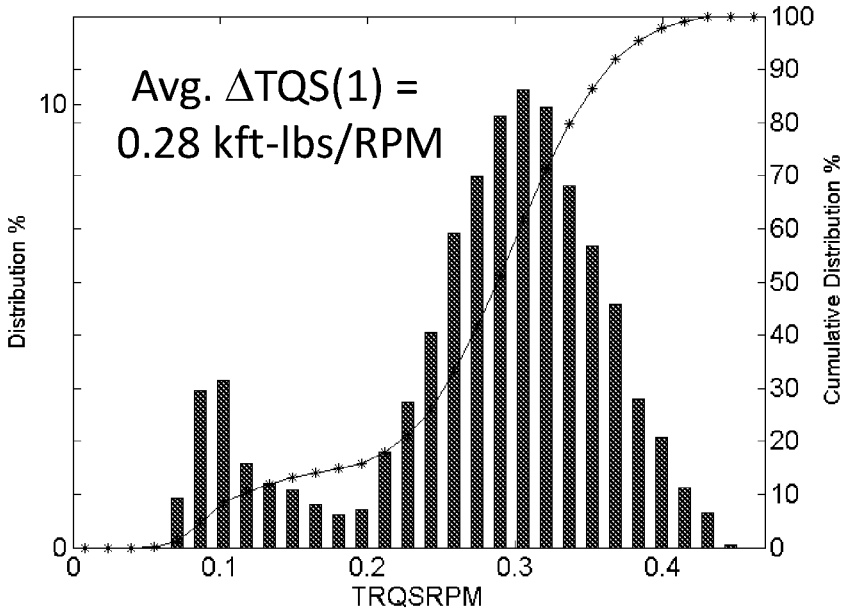
FIG. 4C shows the specific surface torque swing per RPM distribution for Well 1.
Figure 6B:
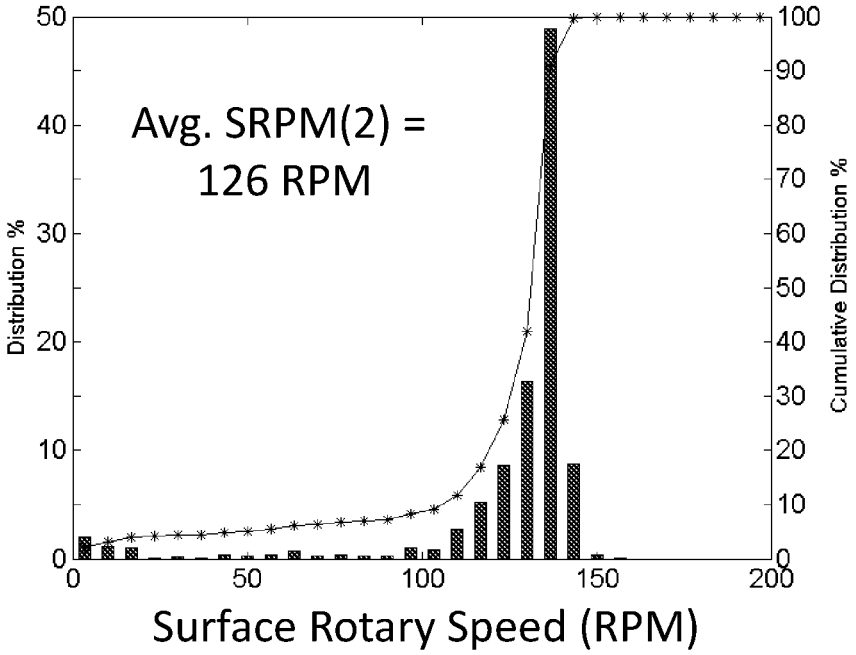
FIG. 6B shows the surface rotary speed distribution for Well 2.
Figure 6C:
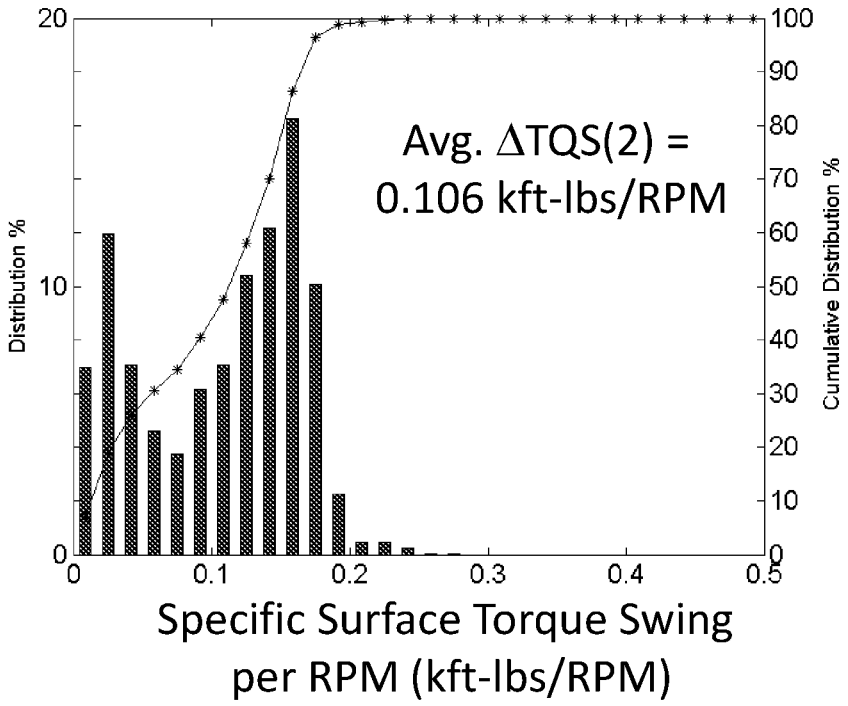
FIG. 6C shows the specific surface torque swing per RPM distribution for Well 2.

FIGS. 4B and 6B illustrate the distribution of surface rotary speed for the drilling operations in each well. The specific torque swing per RPM may be calculated on a point by point basis by dividing the recorded torque swing $\Delta TQ_i$ over a cycle by the average SRPM over the interval, providing the data tracks of the specific surface torque swing, ΔTQS, in FIGS. 2A and 2B. The distributions of this ΔTQS data may be the displayed as seen in FIGS. 4C and 6C.

Figure 4D:
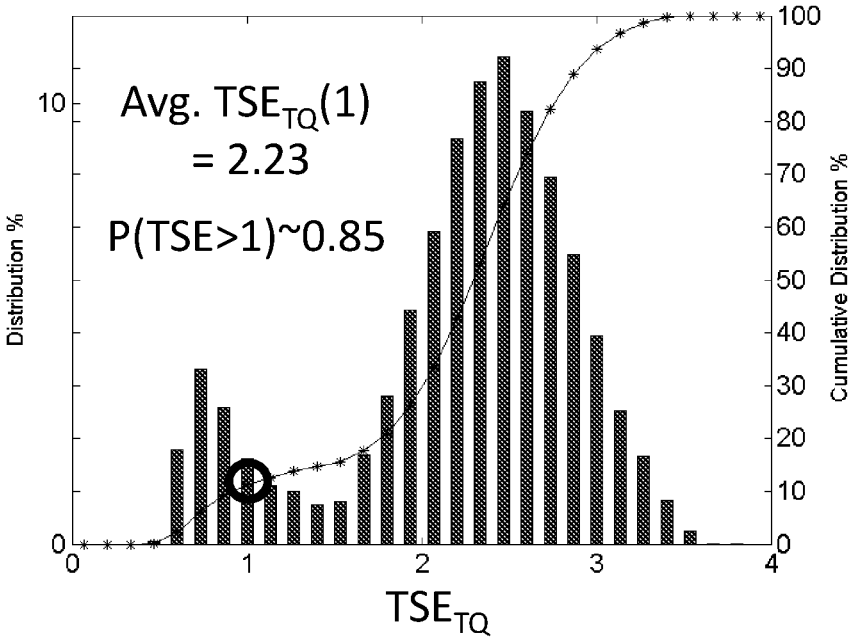
FIG. 4D provides the $TSE_{TQ}$ distribution for Well 1, using the data from FIG. 4C for specific torque swing per RPM and the $\Delta TQS_{ref,1}$ value for Well 1 from FIG. 3.
Figure 6D:
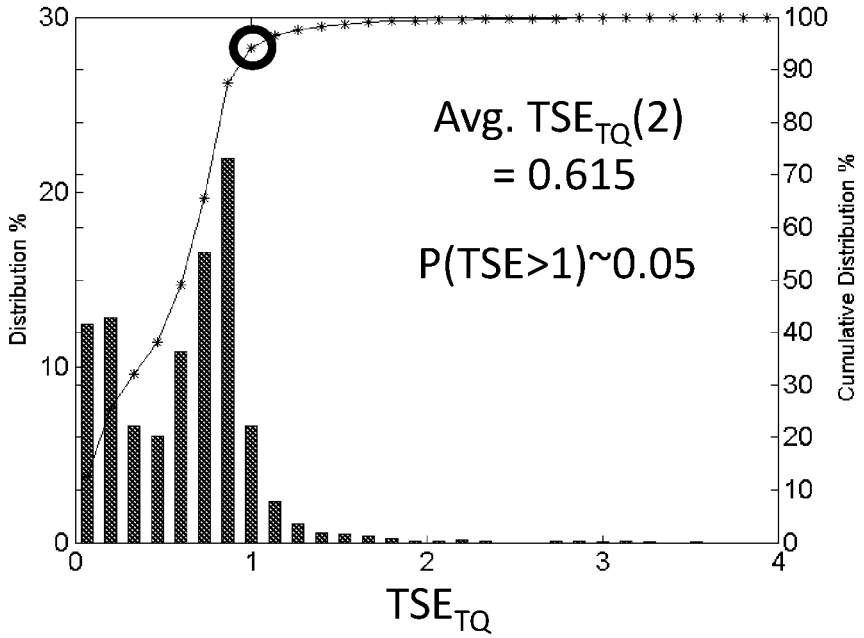
FIG. 6D provides the $TSE_{TQ}$ distribution for Well 2, using the data from FIG. 6C and the $\Delta TQS_{ref,2}$ value for Well 2 from FIG. 3.
Figure 6E:
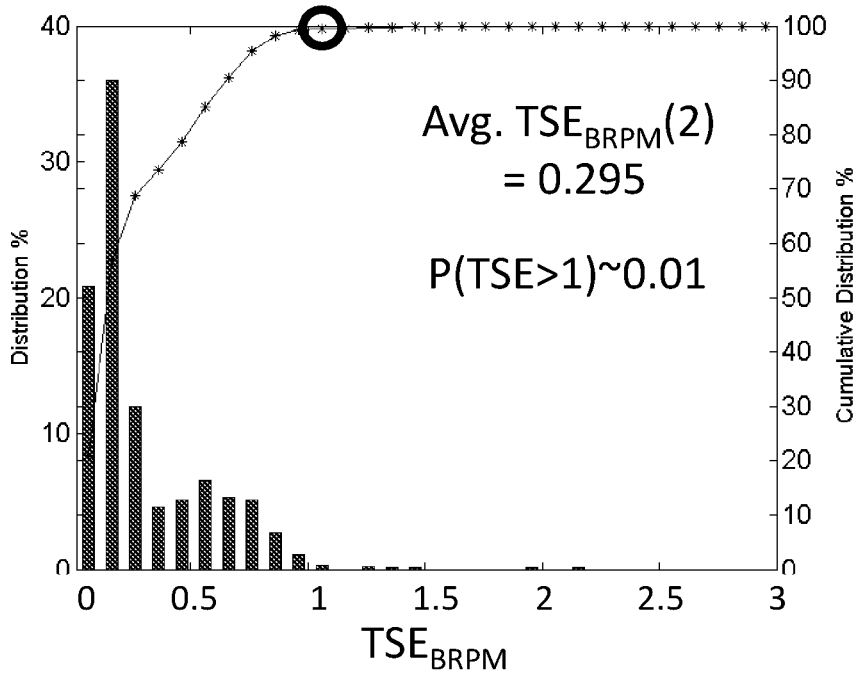
FIG. 6E illustrates the $TSE_{BRPM}$ distribution for Well 2.
Figure 6F:
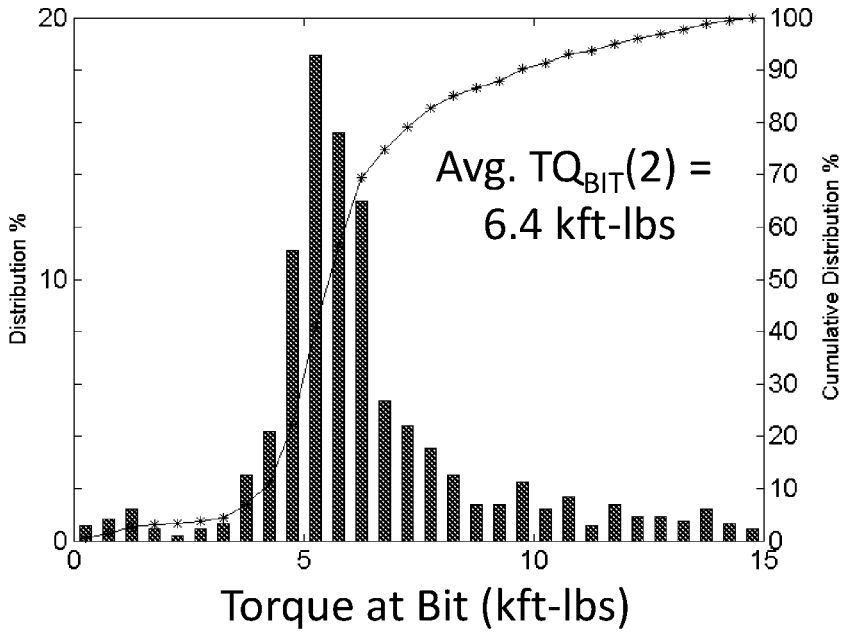
FIG. 6F shows the torque at bit distribution for Well 2.

Equation 1 is then used to calculate $TSE_{TQ}$ for each well, again for each data sample and torque cycle that is recorded. It is beneficial to have surface data recorded at no less than 1 second sampling intervals. The respective $TSE_{TQ}$ distributions for Well 1 and Well 2 are shown in FIGS. 4D and 6D, respectively. The cumulative $TSE_{TQ}$ distributions in the two wells are remarkably different. In FIG. 4D, the P-value of TSE>1 is about 0.85, whereas in FIG. 6D the P-value is 0.05. This is indicative of much greater stick-slip severity in Well 1.

Regarding Well 1 (and associated Drillstring 1), during operation, the torque swing at the surface and the surface rotary speed were recorded. The torque swing at the surface distribution is shown in FIG. 4A, and the average value was 25.9 kft-lbs. The surface rotary speed distribution is shown in FIG. 4B, and the average value was 91 rpm. In FIGS. 4A-4F and 6A-6F, it is noted that the bars show the actual data distribution for the measured or calculated parameter.

As noted above, the line with an asterisk (*) designation shows the cumulative distribution % of the measured or calculated parameter. From this data, the specific torque swing per rpm was calculated and the distribution is shown in FIG. 4C, with an average value of 0.28 kft-lbs/rpm for the interval.

A value for $\Delta TQS_{ref}$ for Drillstring 1 (which was utilized in drilling Well 1) was calculated using the design information for Drillstring 1 shown in Table 1A. The $\Delta TQS_{ref}$ value for Drillstring 1 was calculated to be 0.125 kft-lbs/rpm as shown in FIG. 3. This is less than half of the average ΔTQS value calculated for the recorded data shown in FIG. 4C. It can therefore be inferred from the data that the drill string did not have sufficient "torque swing capacity" for the loads that were encountered while drilling for efficient drilling operations.

According to the methods as disclosed herein, using the $\Delta TQS_{ref}$ value for Drillstring 1, the $TSE_{TQ}$ distribution for Well 1 was calculated and is shown in FIG. 4D. The average value for $TSE_{TQ}$ is 2.2 and about 85% of the distribution exceeds the full stick-slip condition of TSE=1.0. As can be seen in FIG. 4D, this Drillstring 1 was experiencing "severe" stick slip conditions (i.e., TSE>1) for the majority of the operation.

Figure 4E:
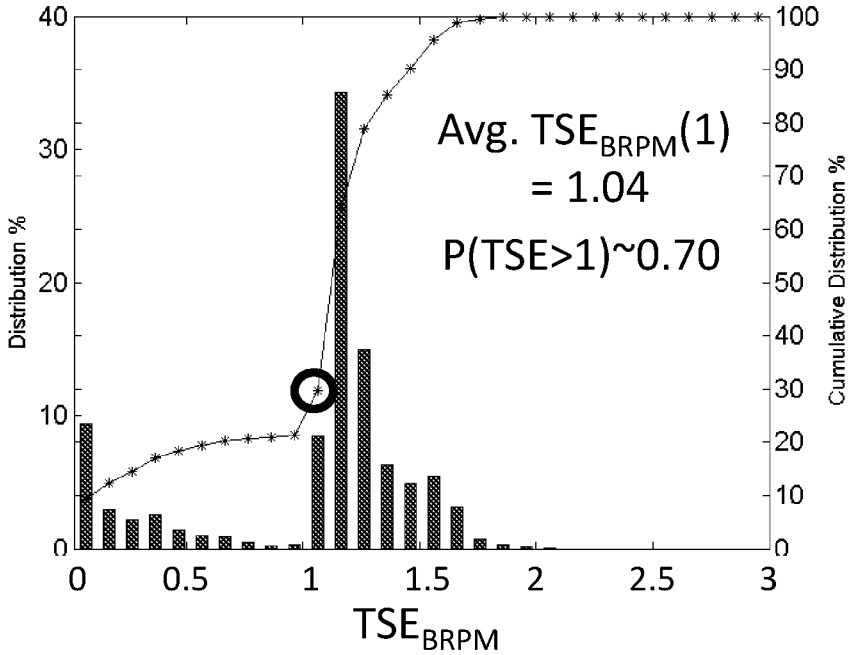
FIG. 4E illustrates the $TSE_{BRPM}$ distribution for Well 1.
Figure 4F:
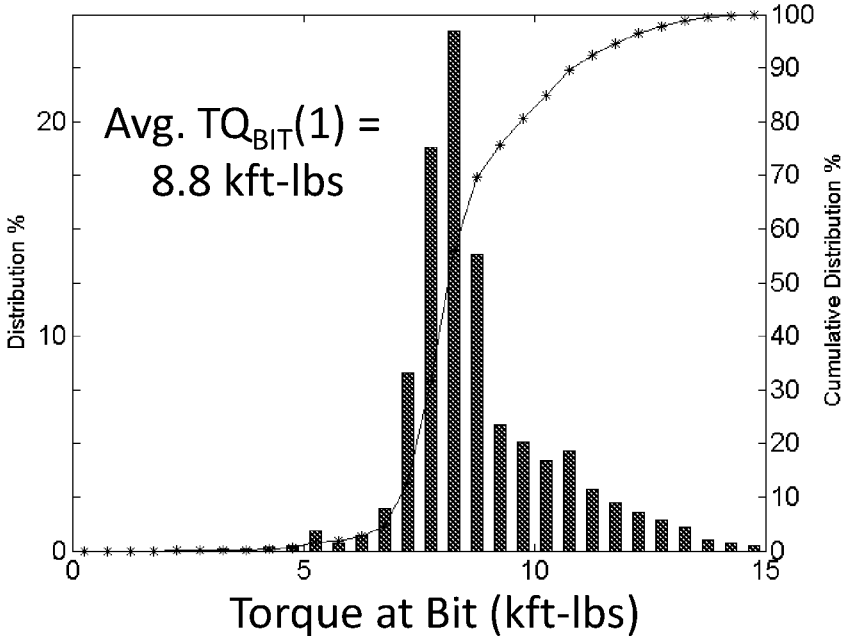
FIG. 4F shows the torque at bit distribution for Well 1.

The Well 1 data also included downhole (at bit) torque and RPM monitoring. The actual torque at bit data for Well 1 is shown in FIG. 4F, with an average value of 8.8 kft-lbs. Utilizing the methods disclosed herein for calculating the TSE based on the downhole data (i.e., the $TSE_{BRPM}$ equations), the $TSE_{BRPM}$ distribution for Well 1 was calculated and is shown in FIG. 4E, with an average value of 1.04. As can be seen in FIG. 4E, the $TSE_{BRPM}$ based on the downhole data confirms that Drillstring 1 was experiencing "severe" stick slip conditions (i.e., TSE>1) for the majority of the operation.

Applying Eq. 13 to the initial distributions for Well 1 with modified parameters may yield insight into the amount of improvement that may be expected by appropriate redesign. In this case, the "modified" parameters for Well 2 can be applied to the Well 1 data.

In this case, the drill string was modified from the Table 1A description to Table 1B, providing for an increase in $\Delta TQS_{ref}$ from 0.125 to 0.178 kft-lbs/RPM. The surface rotary speed was increased from an average of 91 to 126 RPM. The wellbore size was reduced and the bit was redesigned with increased blade count and less aggressive cutting structure, so a reduction in DTOR of approximately 30% is expected. For consistency with the Well 2 dataset since the downhole bit torque data was available, the calculated ratio of 0.73 is utilized below which is reasonably within the same value.

$$TSE_2 = TSE_1 \cdot \frac{\Delta TQS_{ref\,1}}{\Delta TQS_{ref\,2}} \cdot \frac{SRPM_1}{SRPM_2} \cdot \frac{DTOR_2}{DTOR_1}$$

Therefore, $$TSE_{1,mod} = TSE_{1,init} \cdot \frac{125}{178} \cdot \frac{91}{126} \cdot \frac{6.4}{8.8}$$

$$TSE_{1,mod} = TSE_{1,init} \cdot (0.70) \cdot (0.72) \cdot (0.73)$$

$$TSE_{1,mod} = (0.37) \cdot TSE_{1,init}$$

Figure 5A:
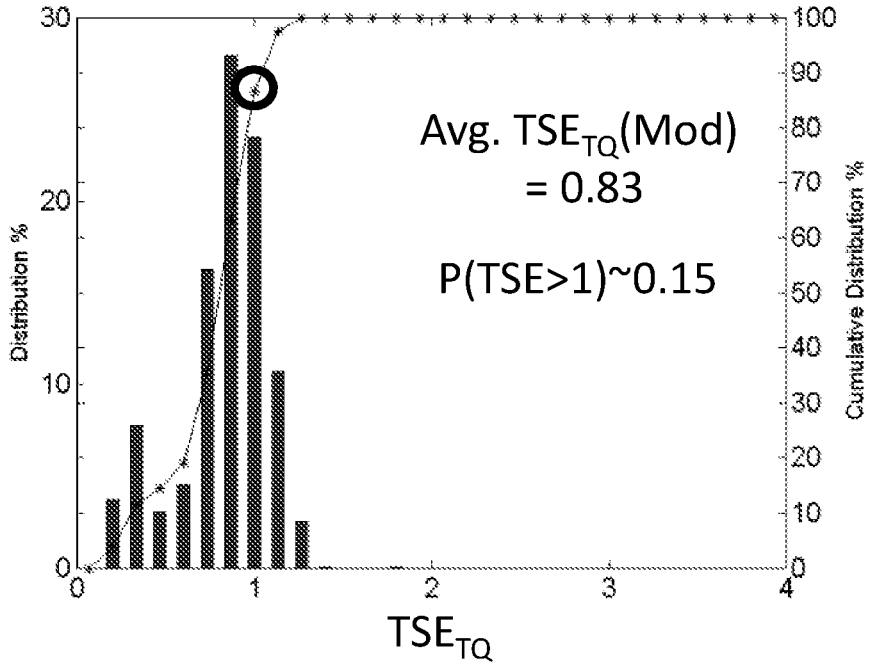
FIG. 5A illustrates the calculated $TSE_{TQ}$ distribution for the modified Well 1 operations using a ratio of 0.37, based on the data in FIG. 4D.
Figure 5B:
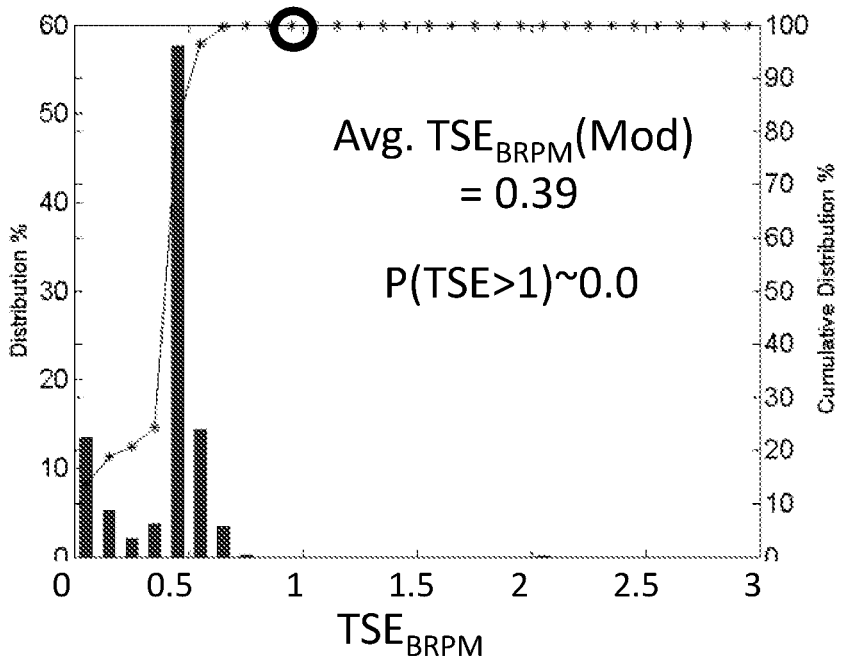
FIG. 5B illustrates the calculated $TSE_{BRPM}$ distribution for the modified Well 1 operations using a ratio of 0.37, based on the data in FIG. 4E.

Application of this scaling factor to the Well 1 $TSE_{TQ}$ data shown in FIG. 4D, and replotting as a distribution, FIG. 5A is obtained which illustrates a calculated $TSE_{TQ}$ distribution for the modified Well 1, based on the data in FIG. 4D and the modified drill string and drilling parameters. The same scale factor may then be applied to the $TSE_{BRPM}$ data shown in FIG. 4E, resulting in the modified chart seen in FIG. 5B which illustrates the calculated $TSE_{BRPM}$ distribution for the modified Well 1 operations, based on the data in FIG. 4E and the modified drill string and drilling parameters.

In Well 2, the same challenging formation was encountered over the corresponding interval in Well 1. FIGS. 6A-6F (based on actual Well 2 and Drillstring 2 data & drilling parameters) correspond in similar manner to the information in FIGS. 4A-4F (based on actual Well 1 and Drillstring 1 data & drilling parameters) as have just been described. The data acquisition, calculated drilling parameters, and resulting graphs and figures for FIGS. 6A-6F correspond to the same methodology as described for corresponding FIGS. 4A-4F in this example.

Table 2 provides a portion of the summarized data described above for the three cases: actual Well 1 data using the initial drill string and initial drilling parameters in an actual well drilling operation (Well 1), Well 1 data transformed using the modified drill string and modified drilling parameters (Well 1 (mod)), and actual Well 2 data using the modified drill string and modified drilling parameters in an actual well drilling operation (Well 2) for comparison.

TABLE 2

TSE Values for Well 1, Well 1 (mod), and Well 2

| TSE Type | Metric | Well 1 | Well 1 (mod) | Well 2 |
|---|---|---|---|---|
| $TSE_{TQ}$ | Average | 2.23 | 0.83 | 0.62 |
| | P (TSE > 1) | 0.85 | 0.15 | 0.05 |
| $TSE_{BRPM}$ | Average | 1.04 | 0.39 | 0.30 |
| | P (TSE > 1) | 0.70 | 0.00 | 0.01 |

Figure 7:
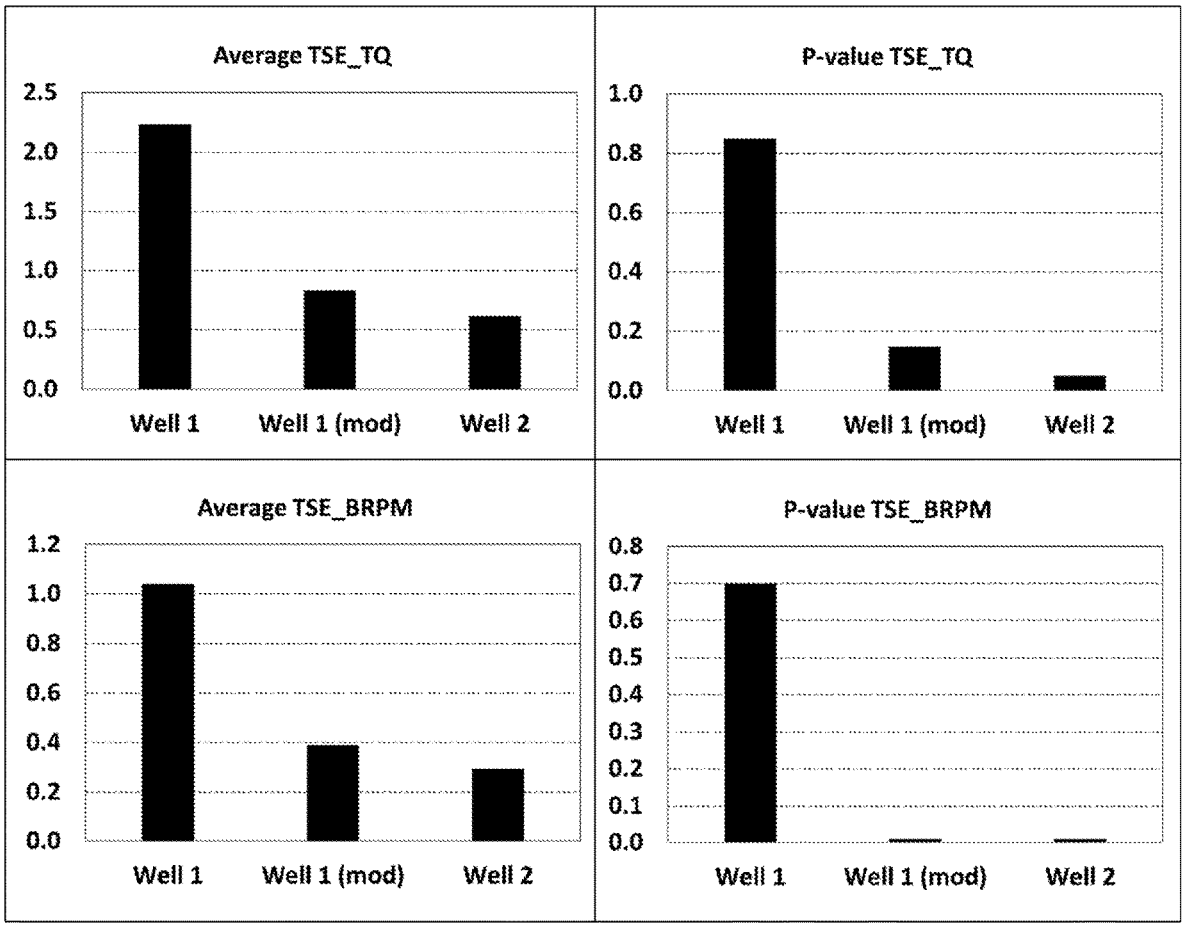
FIG. 7 provides TSE calculation results for Well 1, Well 1 (mod), and Well 2.

FIG. 7 provides a graphical representation of this data, which shows that the modeling data obtained according to embodiments of the present discovery as described herein correlates exceptionally accurately with the actual data. It may be seen that substantial reduction in stick-slip would be expected if using the modified drill string and modified parameters that were indeed used in Well 2 in the original Well 1 operation. Furthermore, transformation of the TSE distribution for Well 1 using the modified drill string and drilling parameters that were used in Well 2 provides a good approximation of the actual measured distributions observed drilling Well 2. These results provide technical evidence that this method yields results of acceptable engineering accuracy for the purpose of redesign of a stick-slip vibration limit.

In an exemplary embodiment, a modified drill string, a modified operating parameter, or both can be determined based on a Torsional Severity Estimate ($TSE_{init}$) for a drilling operation. In an exemplary embodiment, herein is a method for drilling a wellbore in a subterranean formation, comprising:

a) obtaining initial drilling parameters characterizing an initial drilling operation using an initial drill string that was used to drill a portion of a wellbore or a different wellbore;

b) determining an initial Torsional Severity Estimate ($TSE_{init}$) for at least a portion of the drilling operation;

c) determining a reference value for a theoretical specific surface torque swing at full stick-slip per RPM for the initial drill string ($\Delta TQS_{ref,init}$) for the initial drilling operation;

d) determining at least one modified drill string wherein the modified drill string is different from the initial drill string, at least one modified drilling parameter wherein the modified drilling parameter is different from the initial drilling parameter, or a combination thereof, for a modified drilling operation;

e) determining a reference value for a theoretical specific surface torque swing at full stick-slip per RPM for the modified drill string ($\Delta TQS_{ref,mod}$) for the modified drilling operation;

f) calculating a Torsional Severity Estimate ($TSE_{mod}$) for the modified drilling operation using the at least one modified drill string, the at least one modified drilling parameter, or a combination thereof, using at least one of:

i) a ratio of theoretical specific surface torque swing at full stick-slip per RPM for the initial drill string ($\Delta TQS_{ref,init}$) and the modified drill string ($\Delta TQS_{ref,mod}$);

ii) a ratio of surface rotary speed (SRPM) for the initial drilling operation and the modified drilling operation; or iii) a ratio of downhole torque (DTOR) values for the initial drilling operation and the modified drilling operation;

g) selecting one of the following:

i) the initial drill string and at least one modified drilling parameter, ii) the at least one modified drill string, or iii) the at least one modified drill string and at least one modified drilling parameter; and h) drilling the wellbore in a subterranean formation using a drilling system comprising the selection from step (g).

In another exemplary embodiment, based on the initial drilling parameters include surface torque-swing ($\Delta TQ$), drill string surface rotary speed (SRPM), measured depth (MD), and a theoretical specific surface torque-swing at full stick-slip per RPM ($\Delta TQS_{ref}$) of the initial drill string, using the calculations and methods referenced above, the following method may be utilized. A method is described herein for drilling a wellbore in a subterranean formation comprising:

a) obtaining initial drilling parameters characterizing a drilling operation using an initial drill string, wherein the initial drilling parameters include surface torque-swing ($\Delta TQ$), drill string surface rotary speed (SRPM), measured depth (MD), and a theoretical specific surface torque-swing at full stick-slip per RPM ($\Delta TQS_{ref}$) for the initial drill string and for a modified drill string;

b) calculating a distribution of specific surface torque-swing per RPM ($\Delta TQS$) for at least a portion of the drilling operation using the initial drill string and the initial drilling parameters;

c) determining a distribution of specific surface torque-swing per RPM ($\Delta TQS$) for the drilling operation using the initial drill string and modified drilling parameters;

d) determining a distribution of specific surface torque-swing per RPM ($\Delta TQS$) for the drilling operation using the modified drill string and the initial drilling parameters;

e) determining a distribution of specific surface torque-swing per RPM ($\Delta TQS$) for the drilling operation using the modified drill string and the modified drilling parameters;

f) selecting one of the following as the selected drill string and the selected drilling parameters: the initial drill string and the initial drilling parameters from (a and b); the initial drill string with the modified drilling parameters from (c); the modified drill string with the initial drilling parameters from (d); or the modified drill string with the modified drilling parameters from (e), where the selection is based on the distribution of the specific surface torque swing per RPM ($\Delta TQS$) for each of the four cases; and g) drilling a wellbore in a subterranean formation using a drilling system comprising the selected drill string and the selected drilling parameters from step f).

Conversely, in another exemplary embodiment, a method is described herein for drilling a wellbore in a subterranean formation comprising:

a) obtaining drilling parameters characterizing a drilling operation using an initial drill string, wherein the drilling parameters include surface torque-swing, drill string surface rotary speed, measured depth, and a theoretical surface torque swing at full stick-slip per RPM ($\Delta TQS_{ref}$) of the initial drill string;

b) calculating a distribution of the specific surface torque-swing per RPM ($\Delta TQS$) for at least a portion of the drilling operation using the initial drill string;

c) selecting a desired value for a theoretical specific surface torque-swing at full stick-slip per RPM ($\Delta TQS_{ref}$) for the drilling operation for a modified drill string design based on the overall distribution of specific surface torque swing data per RPM ($\Delta TQS$) for the drilling operation using the initial drill string;

d) designing a modified drill string based on the desired value for the theoretical specific surface torque-swing at full stick-slip per RPM ($\Delta TQS_{ref}$) for the drilling operation;

e) selecting drilling parameters to operate the modified drill string; and f) drilling a wellbore in a subterranean formation using a drilling system comprising the modified drill string.

Different proposed drill string assemblies and configurations for drill string assemblies can be quickly checked using the embodiments herein to determine a proposed drill string design for the well drilling operations with reduced or optimized induced torsional vibration under the drilling operation conditions. The appropriate drill string can then be selected by the methods herein for drilling a wellbore which can reduce or optimize the duration (or percentage) of time that the drill string assembly will experience severe stick-slip. The drill string selected utilizing this method, the selected drill string, is then utilized to drill a wellbore in a subterranean formation.

The key ideas of these procedures and methodologies are further explained by referring to FIG. 4A. This figure shows the actual torque swing data for a Well 1 as described in the Example herein. FIG. 4B shows a graph of the surface rotary speed data of the drill stem and FIG. 4C shows the torque swing per rpm data of the drill stem. The $\Delta TQS_{ref}$ of the drill string can be determined using the calculations and methods referenced above. In this case, as shown in FIG. 2 of the Example, the $\Delta TQS_{ref}$ of the drill string was determined to be 125 ft-lbs/rpm based on the drill string physical configuration as shown in Table 1 of the Example. Using the methods disclosed above, a $TSE_{TQ}$ distribution based on the initial drill string can further be determined. This is shown in FIG. 4D of the Example.

As such, in another exemplary embodiment, a method is described herein for drilling a wellbore in a subterranean formation comprising:

a) obtaining drilling parameters characterizing a drilling operation using an initial drill string, wherein the drilling parameters include specific surface torque-swing per RPM ($\Delta TQS$) and drill string surface rotary speed (SRPM) or drill string bit rotary speed (BRPM), and using the initial drill string;

b) calculating an overall distribution of a Torsional Severity Estimate (TSE) for at least a portion of the drilling operation using the initial drill string;

c) calculating a theoretical specific surface torque-swing at full stick-slip per RPM ($\Delta TQS_{ref}$) for at least one modified drill string;

d) selecting a final drill string from the at least one modified drill string;

e) selecting drilling parameters to operate the modified drill string; and f) drilling a wellbore in a subterranean formation using a drilling system comprising the final drill string.

Alternatively, TSE distributions for an existing drill string can be obtained based on different methods as disclosed herein and a distribution of TSE may be calculated for at least a portion of the drilling operation using at least one selected value for a the theoretical surface torque-swing at full stick-slip per RPM $\Delta TQS_{ref}$. From this information one can select or design a final drill string based the distribution of TSE for at least a portion of the drilling operation for the at least one selected value for $\Delta TQS_{ref}$. As such, in another exemplary embodiment, a method is described herein for drilling a wellbore in a subterranean formation comprising:

a) obtaining drilling parameters characterizing a drilling operation using an initial drill string, wherein the drilling parameters include surface torque-swing ($\Delta TQ$), drill string surface rotary speed (SRPM) or drill string bit rotary speed (BRPM), and measured depth (MD) using the initial drill string;

b) calculating a distribution of a Torsional Severity Estimate (TSE) for at least a portion of the drilling operation using the initial drill string;

c) calculating a distribution of TSE for at least a portion of the drilling operation using at least one selected value for the theoretical specific surface torque-swing at full stick-slip per RPM ($\Delta TQS_{ref}$);

d) selecting or designing a final drill string based on the distribution of TSE for at least a portion of the drilling operation for the at least one selected value for $\Delta TQS_{ref}$; and e) drilling a wellbore in a subterranean formation using a drilling system comprising the final drill string.

Different proposed drill string designs can be quickly checked in this manner to determine a proposed drill string design for the well drilling operations. The appropriate drill string can then be selected by this method for drilling a wellbore which can reduce or optimize the duration (or percentage) of time that the drill string assembly will experience severe stick-slip and using the drill string selected utilizing this method, the selected drill string, is utilized to drill a wellbore in a subterranean formation. The processes herein may also be used to determine modified operating parameters such as to optimize the stick-slip condition on an existing or partially modified drill string or drilling operation for a drill string. In another exemplary embodiment, a method is described herein for drilling a wellbore in a subterranean formation comprising:

a) obtaining a value of at least one initial drilling parameter characterizing a drilling operation using a drill string selected from a drill string surface rotary speed (SRPM), a drill bit coefficient of friction ($\mu$), a weight-on-bit (W), and a hole diameter (D);

b) calculating a distribution of a Torsional Severity Estimate (TSE) for at least a portion of the drilling operation using the drill string;

c) determining a value of at least one modified drilling parameter selected from the drill string surface rotary speed (SRPM), the drill bit coefficient of friction ($\mu$), the weight-on-bit (W), and the hole diameter (D), wherein the value of the at least one modified drilling parameter is different from the value of the at least one initial drilling parameter; and d) drilling a wellbore in a subterranean formation using the drill string and the at least one modified drilling parameter.

The methods disclosed herein teaches and enables new and useful drilling engineering and design methods that can be used to optimize the design of equipment for wellbore drilling processes to perform wellbore drilling processes that are more reliable and are more time and cost effective than previous methods.

In other embodiments, the present inventive subject matter includes:

Embodiment 1

A method for drilling a wellbore in a subterranean formation, comprising:

a) obtaining initial drilling parameters characterizing an initial drilling operation using an initial drill string that was used to drill a portion of a wellbore or a different wellbore;

b) determining an initial Torsional Severity Estimate ($TSE_{init}$) for at least a portion of the drilling operation;

c) determining a reference value for a theoretical specific surface torque swing at full stick-slip per RPM for the initial drill string ($\Delta TQS_{ref,init}$) for the initial drilling operation;

d) determining at least one modified drill string wherein the modified drill string is different from the initial drill string, at least one modified drilling parameter wherein the modified drilling parameter is different from the initial drilling parameter, or a combination thereof, for a modified drilling operation;

e) determining a reference value for a theoretical specific surface torque swing at full stick-slip per RPM for the modified drill string ($\Delta TQS_{ref,mod}$) for the modified drilling operation;

f) calculating a Torsional Severity Estimate ($TSE_{mod}$) for the modified drilling operation using the at least one modified drill string, the at least one modified drilling parameter, or a combination thereof, using at least one of:

i) a ratio of theoretical specific surface torque swing at full stick-slip per RPM for the initial drill string ($\Delta TQS_{ref,init}$) and the modified drill string ($\Delta TQS_{ref,mod}$);

ii) a ratio of surface rotary speed (SRPM) for the initial drilling operation and the modified drilling operation; or iii) a ratio of downhole torque (DTOR) values for the initial drilling operation and the modified drilling operation;

g) selecting one of the following:

i) the initial drill string and at least one modified drilling parameter, ii) the at least one modified drill string, or iii) the at least one modified drill string and at least one modified drilling parameter; and h) drilling the wellbore in a subterranean formation using a drilling system comprising the selection from step (g).

Embodiment 2

The method of Embodiment 1, wherein the $TSE_{init}$ determined in step (b) is calculated from the surface torque data for the initial drilling operation.

Embodiment 3

The method of Embodiment 1, wherein the $TSE_{init}$ determined in step (b) is calculated from the bit rotational speed data for the initial drilling operation.

Embodiment 4

The method of any one of Embodiments 1-3, wherein the reference $\Delta TQS_{ref,init}$ determined in step (c) is calculated from a dynamic model of the initial drill string.

Embodiment 5

The method of any one of Embodiments 1-4, wherein the reference $\Delta TQS_{ref,mit}$ determined in step (c) is calculated from the data recorded during the initial drilling operation with the initial drill string.

Embodiment 6

The method of any one of Embodiments 1-5, wherein the reference $\Delta TQS_{ref,mod}$ determined in step (e) is calculated from a dynamic model of the modified drill string.

Embodiment 7

The method of any one of Embodiments 1-6, wherein criteria in the selection process of step (g) includes the P-value of the cumulative distribution exceeding $TSE_{mod}=1$, such that the P-value is less than 5%.

Embodiment 8

The method of any one of Embodiments 1-6, wherein criteria in the selection process of step (g) includes the P-value of the cumulative distribution exceeding $TSE_{mod}=1$, such that the P-value is less than 10%.

Embodiment 9

The method of any one of Embodiments 1-6, wherein criteria in the selection process of step (g) includes the P-value of the cumulative distribution exceeding $TSE_{mod}=1$, such that the P-value is less than 33%.

Embodiment 10

A method for drilling a wellbore in a subterranean formation, comprising:

a) obtaining initial drilling parameters characterizing a drilling operation using an initial drill string, wherein the initial drilling parameters include surface torque-swing (ΔTQ), drill string surface rotary speed (SRPM), measured depth (MD), and a theoretical specific surface torque-swing at full stick-slip per RPM ($\Delta TQS_{ref}$) for the initial drill string and for a modified drill string;

b) calculating a distribution of specific surface torque-swing per RPM (ΔTQS) for at least a portion of the drilling operation using the initial drill string and the initial drilling parameters;

c) determining a distribution of specific surface torque-swing per RPM (ΔTQS) for the drilling operation using the initial drill string and modified drilling parameters;

d) determining a distribution of specific surface torque-swing per RPM (ΔTQS) for the drilling operation using the modified drill string and the initial drilling parameters;

e) determining a distribution of specific surface torque-swing per RPM (ΔTQS) for the drilling operation using the modified drill string and the modified drilling parameters;

f) selecting one of the following as the selected drill string and the selected drilling parameters: the initial drill string and the initial drilling parameters from (a and b); the initial drill string with the modified drilling parameters from (c); the modified drill string with the initial drilling parameters from (d); or the modified drill string with the modified drilling parameters from (e), where the selection is based on the distribution of the specific surface torque swing per RPM (ΔTQS) for each of the four cases; and g) drilling a wellbore in a subterranean formation using a drilling system comprising the selected drill string and the selected drilling parameters from step f).

Embodiment 11

The method of Embodiment 10, wherein the initial drilling parameters are obtained from a previously drilled hole section in the same or an offset well.

Embodiment 12

The method of any one of Embodiments 10-11, wherein the selected drill string and the selected drilling parameters in step f) are selected such that less than 33% of the specific surface torque-swing distribution per RPM (ΔTQS) is greater than the theoretical specific surface torque-swing at full stick-slip per RPM ($\Delta TQS_{ref}$) of the selected drill string.

Embodiment 13

The method of any one of Embodiments 10-11, wherein the selected drill string and selected drilling parameters in step f) are selected such that less than 10% of the specific surface torque-swing distribution per RPM (ΔTQS) is greater than the theoretical specific surface torque-swing at full stick-slip per RPM ($\Delta TQS_{ref}$) of the selected drill string.

Embodiment 14

The method of any one of Embodiments 10-13, wherein the specific surface torque-swing per RPM (ΔTQS) for the drilling operation using a modified drill string is determined at a different average surface rotary speed of the drill string (SRPM) than was used in step d).

Embodiment 15

The method of any one of Embodiments 10-14, wherein the specific surface torque-swing per RPM (ΔTQS) for the drilling operation using a modified drill string is determined at a different measured bit depth (MD) than was used in step d).

Embodiment 16

A method for drilling a wellbore in a subterranean formation, comprising:

a) obtaining drilling parameters characterizing a drilling operation using an initial drill string, wherein the drilling parameters include surface torque-swing, drill string surface rotary speed, measured depth, and a theoretical surface torque swing at full stick-slip per RPM ($\Delta TQS_{ref}$) of the initial drill string;

b) calculating a distribution of the specific surface torque-swing per RPM (ΔTQS) for at least a portion of the drilling operation using the initial drill string;

c) selecting a desired value for a theoretical specific surface torque-swing at full stick-slip per RPM ($\Delta TQS_{ref}$) for the drilling operation for a modified drill string design based on the overall distribution of specific surface torque swing data per RPM (ΔTQS) for the drilling operation using the initial drill string;

d) designing a modified drill string based on the desired value for the theoretical specific surface torque-swing at full stick-slip per RPM ($\Delta TQS_{ref}$) for the drilling operation;

e) selecting drilling parameters to operate the modified drill string; and f) drilling a wellbore in a subterranean formation using a drilling system comprising the modified drill string.

Embodiment 17

The method of Embodiment 16, wherein the drilling parameters are obtained from a previously drilled hole section in the same well or an offset well.

Embodiment 18

The method of any one of Embodiments 16-17, wherein the modified drill string is designed such that less than 33% of an overall specific surface torque-swing per RPM (ΔTQS) distribution of the modified drill string is greater than the theoretical specific surface torque-swing at full stick-slip per RPM ($\Delta TQS_{ref}$) of the modified drill string.

Embodiment 19

The method of any one of Embodiments 16-17, wherein the modified drill string is designed such that less than 10% of an overall specific surface torque-swing per RPM (ΔTQS) distribution of the modified drill string is greater than the theoretical specific surface torque-swing at full stick-slip per RPM ($\Delta TQS_{ref}$) of the modified drill string.

Embodiment 20

The method of any one of Embodiments 16-19, wherein the designing a modified drill string based on the desired value for the theoretical specific surface torque-swing at full stick-slip per RPM ($\Delta TQS_{ref}$) for the drilling operation in step d) is determined at a different average surface rotary speed (SRPM) and bit depth (MD) of the drill string than was obtained in step a).

Embodiment 21

The method of any one of Embodiments 16-20, wherein the actual value for the theoretical specific surface torque-swing at full stick-slip per RPM ($\Delta TQS_{ref}$) for the drilling operation of the modified drill string is within ±33% of the desired value for the theoretical specific surface torque-swing at full stick-slip per RPM for the drilling operation.

Embodiment 22

The method of any one of Embodiments 16-20, wherein the actual value for the theoretical specific surface torque-swing at full stick-slip per RPM ($\Delta TQS_{ref}$) for the drilling operation of the modified drill string is within ±10% of the desired value for the theoretical specific surface torque-swing at full stick-slip per RPM for the drilling operation.

Embodiment 23

A method for drilling a wellbore in a subterranean formation, comprising:

a) obtaining drilling parameters characterizing a drilling operation using an initial drill string, wherein the drilling parameters include specific surface torque-swing per RPM (ΔTQS) and drill string surface rotary speed (SRPM) or drill string bit rotary speed (BRPM), and using the initial drill string;

b) calculating an overall distribution of a Torsional Severity Estimate (TSE) for at least a portion of the drilling operation using the initial drill string;

c) calculating a theoretical specific surface torque-swing at full stick-slip per RPM ($\Delta TQS_{ref}$) for at least one modified drill string;

d) selecting a final drill string from the at least one modified drill string;

e) selecting drilling parameters to operate the modified drill string; and f) drilling a wellbore in a subterranean formation using a drilling system comprising the final drill string.

Embodiment 24

The method of Embodiment 23, wherein step b) includes calculating a $\Delta TQS_{ref}$ for the initial drill string.

Embodiment 25

The method of Embodiment 24, wherein the TSE for the initial drill string is calculated using the formula:

$$TSE_{TQi} = \frac{\text{Torque } Swing_i}{\Delta TQS_{ref} \cdot \text{Average } SRPM_i}$$

Embodiment 26

The method of Embodiment 24, wherein the TSE for the at least one modified drill string is calculated using the formula:

$$TSE_{BRPM\ mod\ i} = TSE_{TQ\ init\ i} \cdot \frac{\Delta TQS_{ref,\ init}}{\Delta TQS_{ref,\ mod}}$$

Embodiment 27

The method of Embodiment 23, wherein the TSE in step b) is a $TSE_{BRPM}$ determined from downhole data using the formula:

$$TSE_{BRPMi} = \frac{\max(BRPM_i, BRPM_{i-1}, \ldots, BRPM_{i-p}) - avg(BRPM_i, BRPM_{i-1}, \ldots, BRPM_{i-p})}{avg(BRPM_i, BRPM_{i-1}, \ldots, BRPM_{i-p})}$$

Embodiment 28

The method of any one of Embodiments 23-27, wherein the drilling parameters are obtained from a previously drilled hole section in the same or an offset well.

Embodiment 29

The method of any one of Embodiments 23-28, wherein the final drill string is selected such that less than 33% of an overall specific surface torque-swing per RPM (ΔTQS) distribution for the final drill string is greater than the theoretical specific surface torque-swing at full stick-slip per RPM ($\Delta TQS_{ref}$) of the final drill string.

Embodiment 30

The method of any one of Embodiments 23-28, wherein the final drill string is selected such that less than 10% of an overall specific surface torque-swing per RPM (ΔTQS) distribution for the final drill string is greater than the theoretical specific surface torque-swing at full stick-slip per RPM ($\Delta TQS_{ref}$) of the final drill string.

Embodiment 31

The method of any one of Embodiments 23-28, wherein the distribution of TSE for the drilling operation using the at least one modified drill string is determined at a different average surface rotary speed (SRPM) and bit depth (MD) of the drill string than was used in step b) for determining the overall distribution of the TSE for the drilling operation using the initial drill string.

Embodiment 32

A method for drilling a wellbore in a subterranean formation, comprising:

a) obtaining drilling parameters characterizing a drilling operation using an initial drill string, wherein the drilling parameters include surface torque-swing (ΔTQ), drill string surface rotary speed (SRPM) or drill string bit rotary speed (BRPM), and measured depth (MD) using the initial drill string;

b) calculating a distribution of a Torsional Severity Estimate (TSE) for at least a portion of the drilling operation using the initial drill string;

c) calculating a distribution of TSE for at least a portion of the drilling operation using at least one selected value for the theoretical specific surface torque-swing at full stick-slip per RPM ($\Delta TQS_{ref}$);

d) selecting or designing a final drill string based on the distribution of TSE for at least a portion of the drilling operation for the at least one selected value for $\Delta TQS_{ref}$; and e) drilling a wellbore in a subterranean formation using a drilling system comprising the final drill string.

Embodiment 33

The method of Embodiment 32, wherein steps b) and c) include calculating a $\Delta TQS_{ref}$ for the initial drill string.

Embodiment 34

The method of Embodiment 33, wherein the TSE for the drilling operation utilizing the initial drill string and TSE for the drilling operation using at least one selected value for $\Delta TQS_{ref}$ is calculated using the formula:

$$TSE_{TQi} = \frac{\text{Torque } Swing_i}{\Delta TQS_{ref} \times \text{Average } SRPM_i}$$

Embodiment 35

The method of Embodiment 33, wherein the TSE for the drilling operation using at least one selected value for $\Delta TQS_{ref}$ is calculated using the formula:

$$TSE_{TQ\,mod\,i} = TSE_{TQ\,init\,i} \cdot \frac{\Delta TQS_{ref,\,init}}{\Delta TQS_{ref,\,mod}}$$

Embodiment 36

The method of any one of Embodiments 32-35, wherein step b) includes calculating a $\Delta TQS_{ref}$ for the initial drill string.

Embodiment 37

The method of Embodiment 32, wherein the TSE in step b) is a $TSE_{BRPM}$ determined from downhole data using the formula:

$$TSE_{BRPMi} = \frac{\max(BRPM_i, BRPM_{i-1}, \ldots, BRPM_{i-p}) - avg(BRPM_i, BRPM_{i-1}, \ldots, BRPM_{i-p})}{avg(BRPM_i, BRPM_{i-1}, \ldots, BRPM_{i-p})}$$

Embodiment 38

The method of any one of Embodiments 32-37, wherein the drilling parameters are obtained from a previously drilled hole section in the same or an offset well.

Embodiment 39

The method of any one of Embodiments 32-38, wherein the final drill string is selected such that less than 33% of an overall specific surface torque-swing per RPM (ΔTQS) distribution for the final drill string is greater than the theoretical specific surface torque-swing at full stick-slip per RPM ($\Delta TQS_{ref}$) of the final drill string.

Embodiment 40

The method of any one of Embodiments 32-38, wherein the final drill string is selected such that less than 10% of an overall specific surface torque-swing per RPM (ΔTQS) distribution for the final drill string is greater than the theoretical specific surface torque-swing at full stick-slip per RPM ($\Delta TQS_{ref}$) of the final drill string.

Embodiment 41

The method of any one of Embodiments 32-40, wherein the distribution of the TSE for the drilling operation using the at least one selected value for the theoretical specific surface torque-swing at full stick-slip per RPM ($\Delta TQS_{ref}$) is determined at a different average surface rotary speed (RPM) and bit depth (MD) of the drill string than was used in step b) for determining the overall distribution of the TSE for the drilling operation using the initial drill string.

Embodiment 42

The method of any one of Embodiments 32-41, wherein the theoretical specific surface torque-swing at full stick-slip per RPM ($\Delta TQS_{ref}$) of the final drill string is within ±33% of the at least one selected value for the theoretical specific surface torque-swing at full stick-slip per RPM for the drilling operation.

Embodiment 43

The method of any one of Embodiments 32-41, wherein the theoretical specific surface torque-swing at full stick-slip per RPM ($\Delta TQS_{ref}$) of the final drill string is within ±10% of the at least one selected value for the theoretical specific surface torque-swing at full stick-slip per RPM for the drilling operation.

Embodiment 44

A method for drilling a wellbore in a subterranean formation, comprising:

a) obtaining a value of at least one initial drilling parameter characterizing a drilling operation using a drill string selected from a drill string surface rotary speed (SRPM), a drill bit coefficient of friction (μ), a weight-on-bit (W), and a hole diameter (D);

b) calculating a distribution of a Torsional Severity Estimate (TSE) for at least a portion of the drilling operation using the drill string;

c) determining a value of at least one modified drilling parameter selected from the drill string surface rotary speed (SRPM), the drill bit coefficient of friction (μ), the weight-on-bit (W), and the hole diameter (D), wherein the value of the at least one modified drilling parameter is different from the value of the at least one initial drilling parameter; and d) drilling a wellbore in a subterranean formation using the drill string and the at least one modified drilling parameter.

Embodiment 45

The method of Embodiment 44, further comprising additionally obtaining a specific surface torque-swing per RPM (ΔTQS) distribution.

Embodiment 46

The method of any one of Embodiments 44-45, wherein the at least one drilling parameter characterizing a drilling operation using the drill string is the surface rotary speed (SRPM), and the at least one modified drilling parameter is the surface rotary speed (SRPM).

Embodiment 47

The method of any one of Embodiments 44-46, wherein the at least one drilling parameter characterizing a drilling operation using the drill string is a weight-on-bit (W), and the at least one modified drilling parameter is the weight-on-bit (W).

Embodiment 48

The method of any one of Embodiments 44-47, wherein the at least one drilling parameter characterizing a drilling operation using the drill string is a drill bit coefficient of friction (μ), and the at least one modified additional drilling parameter is the drill bit coefficient of friction (μ).

Embodiment 49

The method of any one of Embodiments 44-48, wherein step c) further includes selecting a modified drill bit that is different from the drill bit used in step a) for obtaining the drilling parameters characterizing a drilling operation, and step d) further includes drilling the wellbore in a subterranean formation using the modified drill bit.

Embodiment 50

The method of any one of Embodiments 44-49, wherein the at least one additional drilling parameter characterizing a drilling operation using the drill string is a hole diameter (D), and the at least one modified additional drilling parameter is the hole diameter (D).

What is claimed is:

1. A method for drilling a wellbore in a subterranean formation, comprising:

a) obtaining initial drilling parameters characterizing an initial drilling operation using an initial drill string that was used to drill a portion of a wellbore or a different wellbore;

b) determining an initial Torsional Severity Estimate ($TSE_{init}$) for at least a portion of the drilling operation;

c) determining a reference value for a theoretical specific surface torque swing at full stick-slip per RPM for the initial drill string ($\Delta TQS_{ref,init}$) for the initial drilling operation;

d) determining at least one modified drill string wherein the modified drill string is different from the initial drill string, at least one modified drilling parameter wherein the modified drilling parameter is different from the initial drilling parameter, or a combination thereof, for a modified drilling operation;

e) determining a reference value for a theoretical specific surface torque swing at full stick-slip per RPM for the modified drill string ($\Delta TQS_{ref,mod}$) for the modified drilling operation;

f) calculating a Torsional Severity Estimate ($TSE_{mod}$) for the modified drilling operation using the at least one modified drill string, the at least one modified drilling parameter, or a combination thereof, using at least one of:

i) a ratio of theoretical specific surface torque swing at full stick-slip per RPM for the initial drill string ($\Delta TQS_{ref,init}$) and the modified drill string ($\Delta TQS_{ref,mod}$);

ii) a ratio of surface rotary speed (SRPM) for the initial drilling operation and the modified drilling operation; or iii) a ratio of downhole torque (DTOR) values for the initial drilling operation and the modified drilling operation;

g) selecting one of the following:
   i) the initial drill string and at least one modified drilling parameter,
   ii) the at least one modified drill string, or
   iii) the at least one modified drill string and at least one modified drilling parameter; and
h) drilling the wellbore in a subterranean formation using a drilling system comprising the selection from step (g).

2. The method of claim 1, wherein the $TSE_{init}$ determined in step (b) is calculated from the surface torque data for the initial drilling operation.

3. The method of claim 1, wherein the $TSE_{init}$ determined in step (b) is calculated from the bit rotational speed data for the initial drilling operation.

4. The method of claim 1, wherein the reference $\Delta TQS_{ref,init}$ determined in step (c) is calculated from a dynamic model of the initial drill string.

5. The method of claim 1, wherein the reference $\Delta TQS_{ref,init}$ determined in step (c) is calculated from the data recorded during the initial drilling operation with the initial drill string.

6. The method of claim 1, wherein the reference $\Delta TQS_{ref,mod}$ determined in step (e) is calculated from a dynamic model of the modified drill string.

7. The method of claim 1, wherein criteria in the selection process of step (g) includes a P-value of a cumulative distribution exceeding $TSE_{mod}=1$, such that the P-value is less than 10%.

8. A method for drilling a wellbore in a subterranean formation, comprising:
a) obtaining initial drilling parameters characterizing a drilling operation using an initial drill string, wherein the initial drilling parameters include surface torque-swing (ΔTQ), drill string surface rotary speed (SRPM), measured depth (MD), and a theoretical specific surface torque-swing at full stick-slip per RPM ($\Delta TQS_{ref}$) for the initial drill string and for a modified drill string;
b) calculating a distribution of specific surface torque-swing per RPM (ΔTQS) for at least a portion of the drilling operation using the initial drill string and the initial drilling parameters;
c) determining a distribution of specific surface torque-swing per RPM (ΔTQS) for the drilling operation using the initial drill string and modified drilling parameters;
d) determining a distribution of specific surface torque-swing per RPM (ΔTQS) for the drilling operation using the modified drill string and the initial drilling parameters;
e) determining a distribution of specific surface torque-swing per RPM (ΔTQS) for the drilling operation using the modified drill string and the modified drilling parameters;
f) selecting one of the following as the selected drill string and the selected drilling parameters: the initial drill string and the initial drilling parameters from (a and b); the initial drill string with the modified drilling parameters from (c); the modified drill string with the initial drilling parameters from (d); or the modified drill string with the modified drilling parameters from (e), where the selection is based on the distribution of the specific surface torque swing per RPM (ΔTQS) for each of the four cases; and
g) drilling a wellbore in a subterranean formation using a drilling system comprising the selected drill string and the selected drilling parameters from step f).

9. The method of claim 8, wherein the selected drill string and selected drilling parameters in step f) are selected such that less than 10% of the specific surface torque-swing distribution per RPM (ΔTQS) is greater than the theoretical specific surface torque-swing at full stick-slip per RPM ($\Delta TQS_{ref}$) of the selected drill string.

10. A method for drilling a wellbore in a subterranean formation, comprising:
a) obtaining drilling parameters characterizing a drilling operation using an initial drill string, wherein the drilling parameters include surface torque-swing, drill string surface rotary speed, measured depth, and a theoretical surface torque swing at full stick-slip per RPM ($\Delta TQS_{ref}$) of the initial drill string;
b) calculating a distribution of the specific surface torque-swing per RPM (ΔTQS) for at least a portion of the drilling operation using the initial drill string;
c) selecting a desired value for a theoretical specific surface torque-swing at full stick-slip per RPM ($\Delta TQS_{ref}$) for the drilling operation for a modified drill string design based on the overall distribution of specific surface torque swing data per RPM (ΔTQS) for the drilling operation using the initial drill string;
d) designing a modified drill string based on the desired value for the theoretical specific surface torque-swing at full stick-slip per RPM ($\Delta TQS_{ref}$) for the drilling operation;
e) selecting drilling parameters to operate the modified drill string; and
f) drilling a wellbore in a subterranean formation using a drilling system comprising the modified drill string.

11. The method of claim 10, wherein the modified drill string is designed such that less than 10% of an overall theoretical specific surface torque-swing per RPM (ΔTQS) distribution of the modified drill string is greater than the theoretical specific surface torque-swing at full stick-slip per RPM ($\Delta TQS_{ref}$) of the modified drill string.

12. The method of claim 10, wherein the designing a modified drill string based on the desired value for the theoretical specific surface torque-swing at full stick-slip per RPM ($\Delta TQS_{ref}$) for the drilling operation in step d) is determined at a different average surface rotary speed (SRPM) and bit depth (MD) of the drill string than was obtained in step a).

13. The method of claim 10, wherein the actual value for the theoretical specific surface torque-swing at full stick-slip per RPM ($\Delta TQS_{ref}$) for the drilling operation of the modified drill string is within ±10% of the desired value for the theoretical specific surface torque-swing at full stick-slip per RPM for the drilling operation.

14. A method for drilling a wellbore in a subterranean formation, comprising:
a) obtaining drilling parameters characterizing a drilling operation using an initial drill string, wherein the drilling parameters include specific surface torque-swing per RPM (ΔTQS) and drill string surface rotary speed (SRPM) or drill string bit rotary speed (BRPM), and using the initial drill string;
b) calculating an overall distribution of a Torsional Severity Estimate (TSE) for at least a portion of the drilling operation using the initial drill string;
c) calculating a theoretical specific surface torque-swing at full stick-slip per RPM ($\Delta TQS_{ref}$) for at least one modified drill string;
d) selecting a final drill string from the at least one modified drill string;

e) selecting drilling parameters to operate the modified drill string; and f) drilling a wellbore in a subterranean formation using a drilling system comprising the final drill string.

15. The method of claim 14, wherein step b) includes calculating a $\Delta TQS_{ref}$ for the initial drill string, and wherein the TSE for the initial drill string is calculated using the formula:

$$TSE_{TQi} = \frac{\text{Torque } Swing_i}{\Delta TQS_{ref} \times \text{Average } SRPM_i}.$$

16. The method of claim 14, wherein step b) includes calculating a $\Delta TQS_{ref}$ for the initial drill string, and wherein the TSE for the at least one modified drill string is calculated using the formula:

$$TSE_{BRPM\ mod\ i} = TSE_{TQ\ init\ i} \cdot \frac{\Delta TQS_{ref,\ int}}{\Delta TQS_{ref,\ mod}}.$$

17. The method of claim 14, wherein the Torsional Severity Estimate (TSE) in step b) is a $TSE_{BRPM}$ determined from downhole data using the formula:

$$TSE_{BRPMi} = \frac{\max(BRPM_i, BRPM_{i-1}, \ldots, BRPM_{i-p}) - avg(BRPM_i, BRPM_{i-1}, \ldots, BRPM_{i-p})}{avg(BRPM_i, BRPM_{i-1}, \ldots, BRPM_{i-p})}.$$

18. The method of claim 14, wherein the final drill string is selected such that less than 10% of an overall specific surface torque-swing per RPM (ΔTQS) distribution for the final drill string is greater than the theoretical specific surface torque-swing at full stick-slip per RPM ($\Delta TQS_{ref}$) of the final drill string.

19. The method of claim 14, wherein the distribution of TSE for the drilling operation using the at least one modified drill string is determined at a different average surface rotary speed (SRPM) and bit depth (MD) of the drill string than was used in step b) for determining the overall distribution of the TSE for the drilling operation using the initial drill string.

20. A method for drilling a wellbore in a subterranean formation, comprising:

a) obtaining drilling parameters characterizing a drilling operation using an initial drill string, wherein the drilling parameters include surface torque-swing (ΔTQ), drill string surface rotary speed (SRPM) or drill string bit rotary speed (BRPM), and measured depth (MD) using the initial drill string;

b) calculating a distribution of a Torsional Severity Estimate (TSE) for at least a portion of the drilling operation using the initial drill string;

c) calculating a distribution of TSE for at least a portion of the drilling operation using at least one selected value for the theoretical specific surface torque-swing at full stick-slip per RPM ($\Delta TQS_{ref}$);

d) selecting or designing a final drill string based on the distribution of TSE for at least a portion of the drilling operation for the at least one selected value for $\Delta TQS_{ref}$; and e) drilling a wellbore in a subterranean formation using a drilling system comprising the final drill string.

21. The method of claim 20, wherein the final drill string is selected such that less than 10% of an overall specific surface torque-swing per RPM (ΔTQS) distribution for the final drill string is greater than the theoretical specific surface torque-swing at full stick-slip per RPM ($\Delta TQS_{ref}$) of the final drill string.

22. The method of claim 20, wherein the distribution of the TSE for the drilling operation using the at least one selected value for the theoretical specific surface torque-swing at full stick-slip per RPM ($\Delta TQS_{ref}$) is determined at a different average surface rotary speed (RPM) and bit depth (MD) of the drill string than was used in step b) for determining the overall distribution of the TSE for the drilling operation using the initial drill string.

23. The method of claim 20, wherein the theoretical specific surface torque-swing at full stick-slip per RPM ($\Delta TQS_{ref}$) of the final drill string is within ±10% of the at least one selected value for the theoretical specific surface torque-swing at full stick-slip per RPM for the drilling operation.

24. A method for drilling a wellbore in a subterranean formation, comprising:

a) obtaining a value of at least one initial drilling parameter characterizing a drilling operation using a drill string selected from a drill string surface rotary speed (SRPM), a drill bit coefficient of friction (μ), a weight-on-bit (W), and a hole diameter (D);

b) calculating a distribution of a Torsional Severity Estimate (TSE) for at least a portion of the drilling operation using the drill string;

c) determining a value of at least one modified drilling parameter selected from the drill string surface rotary speed (SRPM), the drill bit coefficient of friction (μ), the weight-on-bit (W), and the hole diameter (D), wherein the value of the at least one modified drilling parameter is different from the value of the at least one initial drilling parameter; and d) drilling a wellbore in a subterranean formation using the drill string and the at least one modified drilling parameter.

25. The method of claim 24, further comprising additionally obtaining a specific surface torque-swing per RPM (ΔTQS) distribution.

* * * * *